US008803050B2

(12) United States Patent
Lafferty et al.

(10) Patent No.: US 8,803,050 B2
(45) Date of Patent: Aug. 12, 2014

(54) MICROWAVABLE CONSTRUCT WITH CONTOURED HEATING SURFACE

(75) Inventors: Terrence P. Lafferty, Winneconne, WI (US); Patrick H. Wnek, Sherwood, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 1092 days.

(21) Appl. No.: 11/803,466

(22) Filed: May 15, 2007

(65) Prior Publication Data

US 2008/0000896 A1 Jan. 3, 2008

Related U.S. Application Data

(60) Provisional application No. 60/800,383, filed on May 15, 2006, provisional application No. 60/930,253, filed on May 15, 2007.

(51) Int. Cl.
*H05B 6/80* (2006.01)

(52) U.S. Cl.
USPC ..... 219/730; 219/731; 426/107

(58) Field of Classification Search
CPC ..... H05B 6/6494; H05B 6/6408
USPC ..... 219/730, 725, 762, 756, 759, 734, 729, 219/732; 426/520, 107, 549, 113, 234; 428/580
See application file for complete search history.

(56) References Cited

U.S. PATENT DOCUMENTS 2,859,122 A 11/1958 Maturi et al.
3,965,232 A 6/1976 Chion et al.
4,175,483 A 11/1979 Clark
4,606,496 A 8/1986 Marx et al.
4,609,140 A 9/1986 Van Handel et al.
4,721,499 A 1/1988 Marx et al.
4,721,500 A 1/1988 Van Handel et al.
4,775,771 A 10/1988 Pawlowski
4,777,053 A 10/1988 Tobelmann et al.
4,794,005 A 12/1988 Swiontek
4,831,224 A 5/1989 Keefer
4,832,676 A 5/1989 Johns et al.
4,862,791 A 9/1989 Baughey
4,865,921 A 9/1989 Hollenberg
4,866,234 A * 9/1989 Keefer ..... 219/728
4,870,233 A 9/1989 McDonald et al.

(Continued)

FOREIGN PATENT DOCUMENTS

AU 635667 3/1993
CA 1279902 2/1991

(Continued)

OTHER PUBLICATIONS

International Search Report and Written Opinion mailed Jan. 28, 2011, for PCT/US2010/033118.

(Continued)

*Primary Examiner* — Quang Van

(74) *Attorney, Agent, or Firm* — Womble Carlyle Sandridge & Rice, LLP

(57) ABSTRACT

A tray for heating, browning, and/or crisping a food item in a microwave oven includes a substantially planar base, a platform extending upwardly from the base, and a microwave energy interactive element overlying at least a portion of the platform.

58 Claims, 18 Drawing Sheets

(56) References Cited

U.S. PATENT DOCUMENTS

| | | | | |
|---|---|---|---|---|
| 4,888,459 | A * | 12/1989 | Keefer | 219/728 |
| 4,890,439 | A | 1/1990 | Smart | |
| 4,916,280 | A * | 4/1990 | Havette | 219/731 |
| 4,936,935 | A | 6/1990 | Beckett | |
| 4,963,424 | A | 10/1990 | Beckett | |
| 5,026,958 | A | 6/1991 | Palacios | |
| 5,093,364 | A | 3/1992 | Richards | |
| 5,117,078 | A | 5/1992 | Beckett | |
| 5,213,902 | A | 5/1993 | Beckett | |
| 5,217,768 | A | 6/1993 | Walters et al. | |
| 5,221,419 | A | 6/1993 | Beckett | |
| 5,260,537 | A | 11/1993 | Beckett | |
| 5,266,386 | A | 11/1993 | Beckett | |
| 5,298,708 | A | 3/1994 | Babu et al. | |
| 5,310,977 | A | 5/1994 | Stenkamp et al. | |
| 5,310,980 | A * | 5/1994 | Beckett | 219/709 |
| 5,317,118 | A | 5/1994 | Brandberg et al. | |
| RE34,683 | E | 8/1994 | Maynard | |
| 5,340,436 | A | 8/1994 | Beckett | |
| 5,350,904 | A | 9/1994 | Kemske et al. | |
| 5,354,973 | A | 10/1994 | Beckett | |
| 5,410,135 | A | 4/1995 | Pollart | |
| 5,424,517 | A | 6/1995 | Habeger | |
| 5,519,195 | A | 5/1996 | Keefer | |
| 5,565,228 | A | 10/1996 | Gics | |
| 5,585,027 | A | 12/1996 | Young | |
| 5,628,921 | A | 5/1997 | Beckett | |
| 5,672,407 | A | 9/1997 | Beckett | |
| 5,698,127 | A | 12/1997 | Lai et al. | |
| 5,759,422 | A | 6/1998 | Schmelzer | |
| 5,800,724 | A | 9/1998 | Habeger | |
| 6,114,679 | A | 9/2000 | Lai | |
| 6,150,646 | A | 11/2000 | Lai | |
| 6,150,647 | A | 11/2000 | Anderson et al. | |
| 6,204,492 | B1 | 3/2001 | Zeng | |
| 6,251,451 | B1 | 6/2001 | Zeng | |
| 6,414,290 | B1 | 7/2002 | Cole | |
| 6,415,944 | B1 | 7/2002 | Toussant | |
| 6,433,322 | B2 | 8/2002 | Zeng | |
| 6,455,827 | B2 | 9/2002 | Zeng | |
| 6,463,844 | B1 * | 10/2002 | Wang et al. | 99/426 |
| 6,501,059 | B1 | 12/2002 | Mast | |
| 6,552,315 | B2 | 4/2003 | Zeng | |
| 6,608,292 | B1 | 8/2003 | Barnes | |
| 6,639,199 | B1 | 10/2003 | Ross, Jr. | |
| 6,651,874 | B1 * | 11/2003 | Pedersen | 229/123.1 |
| 6,677,563 | B2 | 1/2004 | Lai | |
| 6,717,121 | B2 | 4/2004 | Zeng | |
| 6,765,182 | B2 | 7/2004 | Cole | |
| 6,919,547 | B2 | 7/2005 | Tsontzidis | |
| 6,988,654 | B2 | 1/2006 | Wnek | |
| 7,019,271 | B2 | 3/2006 | Wnek et al. | |
| 7,205,517 | B2 | 4/2007 | Hoh | |
| 7,323,669 | B2 | 1/2008 | Robison et al. | |
| 7,351,942 | B2 | 4/2008 | Wnek et al. | |
| 7,365,292 | B2 | 4/2008 | Cole et al. | |
| 7,476,830 | B2 | 1/2009 | Middleton et al. | |
| 7,541,562 | B2 | 6/2009 | Cole et al. | |
| 2001/0000732 | A1 | 5/2001 | Hopkins, Sr. | |
| 2003/0085224 | A1 | 5/2003 | Tsontzidis et al. | |
| 2005/0205565 | A1 | 9/2005 | Cole | |
| 2006/0011620 | A1 | 1/2006 | Tsontzidis | |
| 2006/0113300 | A1 | 6/2006 | Wnek | |
| 2007/0029316 | A1 | 2/2007 | Fernandez | |
| 2007/0221666 | A1 | 9/2007 | Keefe et al. | |
| 2008/0000896 | A1 | 1/2008 | Lafferty et al. | |
| 2008/0081095 | A1 | 4/2008 | Cole et al. | |
| 2008/0164178 | A1 | 7/2008 | Wnek et al. | |
| 2009/0206074 | A1 | 8/2009 | Schneider et al. | |
| 2009/0206075 | A1 | 8/2009 | Lafferty | |
| 2010/0278990 | A1 | 11/2010 | Wnek et al. | |

FOREIGN PATENT DOCUMENTS

| | | | |
|---|---|---|---|
| DE | 79 03 283 | | 5/1979 |
| EP | 0007522 | A1 | 2/1980 |
| EP | 0 246 041 | | 11/1987 |
| EP | 0 382 399 | A2 | 8/1990 |
| GB | 2 407 153 | A | 4/2005 |
| JP | S62-293020 | | 12/1987 |
| JP | 07-033228 | U | 6/1995 |
| JP | 15-095332 | | 4/2003 |
| JP | 2003-165582 | A | 6/2003 |
| JP | 19-312819 | | 12/2007 |
| KR | 10-0436263 | | 6/2004 |
| KR | 10-0436263 | B1 | 6/2004 |
| KR | 10-0813904 | B1 | 3/2008 |
| WO | WO 93/23971 | A1 | 11/1993 |
| WO | WO 95/24110 | A2 | 9/1995 |
| WO | WO 96/22228 | A2 | 7/1996 |
| WO | WO 03/041451 | A1 | 5/2003 |
| WO | WO 2004/020310 | | 3/2004 |
| WO | WO 2005/085091 | A2 | 9/2005 |
| WO | WO 2007/133767 | A2 | 11/2007 |
| WO | WO 2008/144343 | A2 | 11/2008 |
| WO | WO 2009/105397 | A2 | 8/2009 |
| WO | WO 2009/105398 | A2 | 8/2009 |
| WO | WO 2010/127214 | A2 | 11/2010 |

OTHER PUBLICATIONS

Supplementary European Search Report mailed Feb. 22, 2011, for EP 08 75 5465.

PCT/US2007/011615—International Search Report, May 11, 2007, Graphic Packaging International, Inc.

PCT/US2007/011615—Written Opinion, May 11, 2007, Graphic Packaging International, Inc.

U.S. Appl. No. 12/008,356, Office Action mailed Mar. 7, 2012.

U.S. Appl. No. 12/008,356, Response submitted May 29, 2012.

International Search Report—PCT/US2008/063615, Dec. 5, 2008, Graphics Packaging International, Inc.

Written Opinion—PCT/US2008/063615, Dec. 5, 2008, Graphic Packaging International, Inc.

International Search Report—PCT/US2009/034191, Sep. 21, 2009, Graphic Packaging International, Inc.

Written Opinion—PCT/US2009/034191, Sep. 21, 2009, Graphic Packaging International, Inc.

International Search Report—PCT/US2009/034190, Sep. 21, 2009, Graphic Packaging International, Inc.

Written Opinion—PCT/US2009/034190, Sep. 21, 2009, Graphic Packaging International, Inc.

Notification of Reason for Refusal for JP 2012-100796 dated Jun. 20, 2013 with English translation.

Supplementary European Search Report for EP 09 71 1698 dated Mar. 28, 2013.

Notice of Allowance and Fee(s) Due dated Jul. 30, 2012 for U.S. Appl. No. 12/008,356.

* cited by examiner

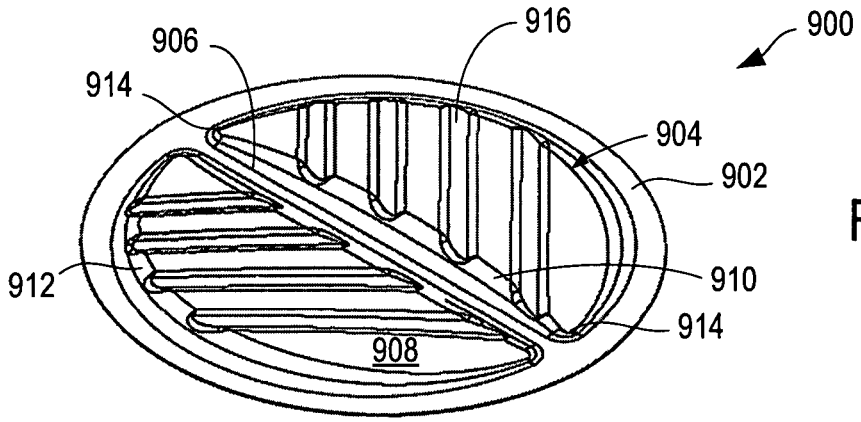
FIG. 9A
FIG. 9E
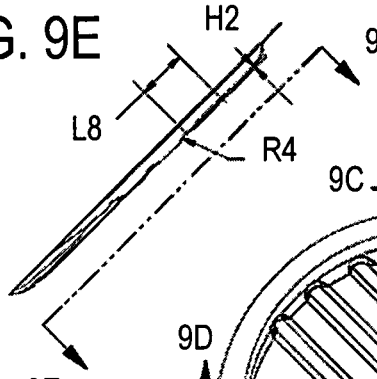
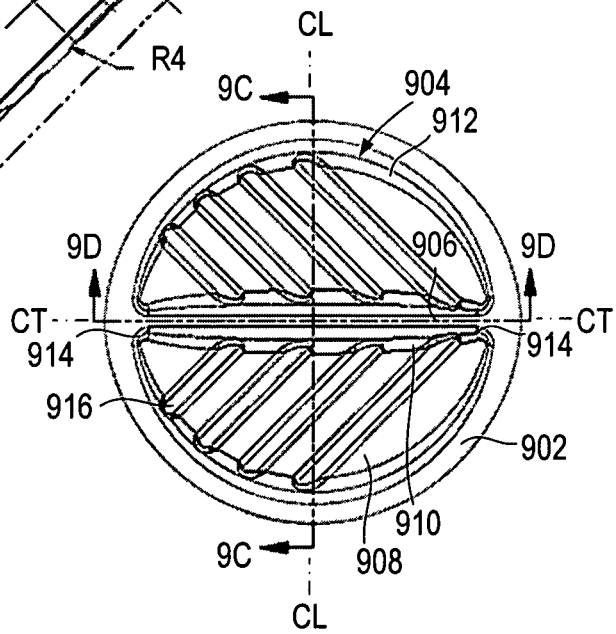
FIG. 9B
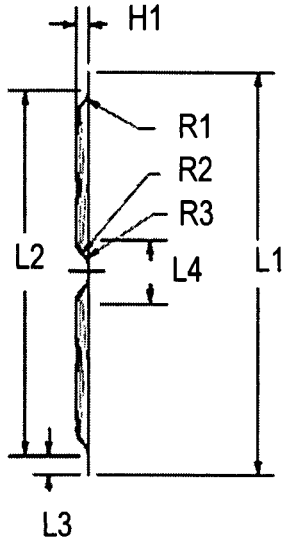
FIG. 9C
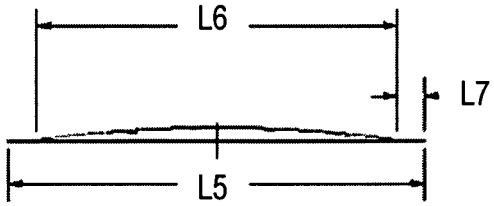
FIG. 9D FIG. 19A
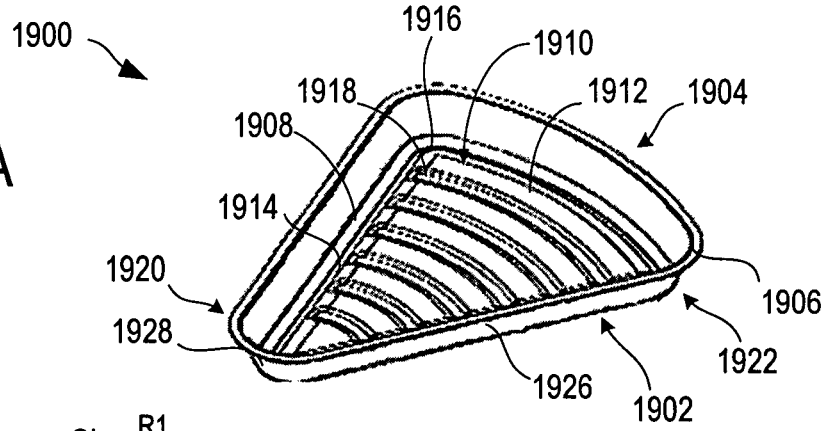
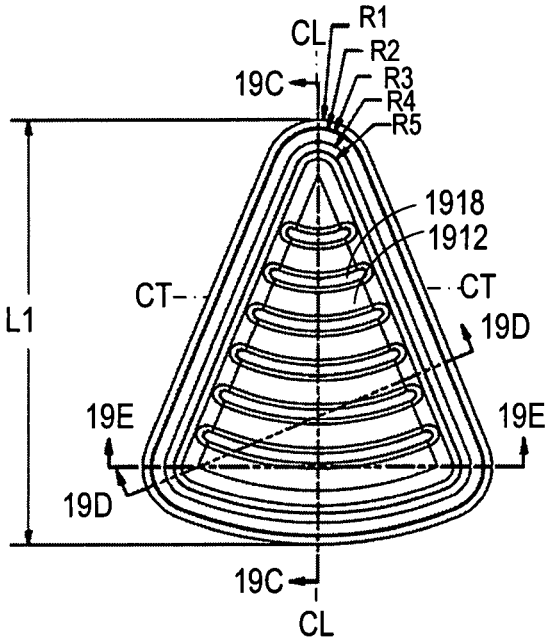
FIG. 19B
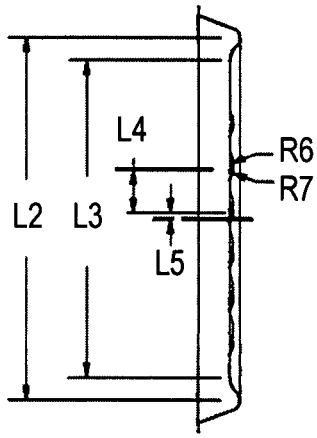
FIG. 19C
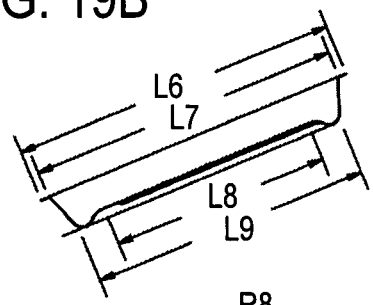
FIG. 19D
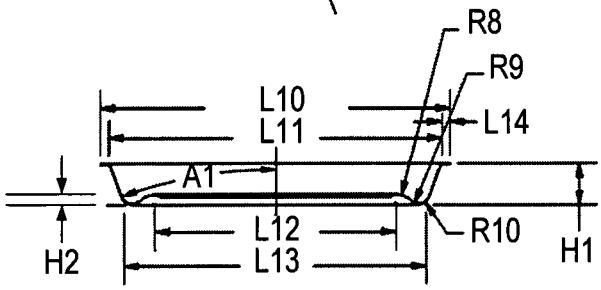
FIG. 19E

MICROWAVABLE CONSTRUCT WITH CONTOURED HEATING SURFACE

CROSS-REFERENCE TO RELATED APPLICATIONS

This application claims the benefit of U.S. Provisional Application No. 60/800,383, filed May 15, 2006, and U.S. Provisional Application No. 60/930,253, May 15, 2007, both of which are incorporated by reference herein in their entirety.

TECHNICAL FIELD

The present invention relates to various materials, packages, constructs, and systems for heating or cooking a food item in a microwave oven. In particular, the invention relates to various materials, packages, constructs, and systems for heating or cooking a food item in a microwave oven, where the food item has an irregular surface.

BACKGROUND

Microwave ovens provide a convenient means for heating a variety of food items, including numerous dough-based and potato-based frozen convenience food items. Unfortunately, in many instances, such items tend to bow, dome, or otherwise warp during the freezing process instead of remaining in their original shape. As a result, many presently available microwave energy interactive packages are unable to provide sufficient contact with the surface of the food item to provide the desired balance of thorough heating with a browned, crisp outer surface. Thus, there is a need for improved materials and packages that provide the desired degree of heating, browning, and/or crisping of a food item having a contoured or irregular surface.

SUMMARY

In accordance with one aspect, the present invention is directed generally to various blanks for forming a microwave energy interactive tray, package, system, or other construct (collectively "constructs"), various constructs formed therefrom, various methods of making such constructs, and various methods of heating, browning, and/or crisping a food item having a contoured or irregular surface in a microwave oven.

The various constructs may include one or more features that enhance microwave heating, browning, and/or crisping of a food item. The various constructs also may include one or more features that accommodate the contours of a food item having an irregular surface, for example, a domed or bowed surface. For example, the various constructs may include one or more elevated or raised portions that bring the microwave enhancing features into closer proximity to the surface of the food item. In some instances, such raised portions may be shaped, sized, and/or configured to create the visual appearance of grill marks. Furthermore, the various constructs may include one or more features that allow moisture generated during the heating process to be vented away from the food item, thereby further enhancing browning and/or crisping. For example, in some examples, the construct may include one or more venting channels extending across at least a portion of the elevated portions.

The elevation patterns, the spacing between elevated portions, the height of the elevations, and the width and depth of the spaces therebetween may be selected based on the type of food item to be heated and the desired cooking effect. For example, greater or fewer elevated portions may be provided, depending on, for example, the degree of irregularity of the surface of the food item to be browned and/or crisped, the moisture content of the food item, the thickness of the food item, characteristics of the food item (e.g., fat content), and the surface area occupied by the food item.

Further, the construct may include one or more depressed portions (as viewed from one side of the construct) corresponding to the elevated portion in the other side of the construct. Where such depressed portions are in the bottom of a construct that, in use, lie adjacent the bottom of a microwave oven, such depressions may provide an insulating air gap that reduces heat loss from the microwave energy interactive element to the microwave oven floor and further enhances heating, browning, and/or crisping of the food item.

The elevated portions may be formed using any suitable method, process, or technique. In one aspect, the contours may be formed using a mechanical and/or thermal pressing process. In such a process, a blank typically is cut to the desired size and shape and placed into a forming mold or die with male and female sides. The male and female sides of the die are brought together, thereby applying pressure to the blank and deforming the blank to create the desired pattern of contours.

Additional aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which:

FIG. 9A is a schematic perspective view of an exemplary variation of the tray of FIGS. 8A-8D according to various aspects of the invention, including obliquely oriented channels;

FIG. 9B is a schematic top plan view of the tray of FIG. 9A;

FIG. 9C is a schematic cross-sectional view of the tray of FIG. 9B taken along a line 9C-9C;

FIG. 9D is a schematic cross-sectional view of the tray of FIG. 9B taken along a line 9D-9D;

FIG. 9E is a schematic cross-sectional view of the tray of FIG. 9B taken along a line 9E-9E;

FIG. 19A is a schematic perspective view of an exemplary variation of the tray of FIGS. 17A-17E according to various aspects of the invention, including additional channels;

FIG. 19B is a schematic top plan view of the tray of FIG. 19A;

FIG. 19C is a schematic cross-sectional view of the tray of FIG. 19B taken along a line 19C-19C;

FIG. 19D is a schematic cross-sectional view of the tray of FIG. 19B taken along a line 19D-19D;

FIG. 19E is a schematic cross-sectional view of the tray of FIG. 19B taken along a line 19E-19E.

DESCRIPTION

Figure 1A:
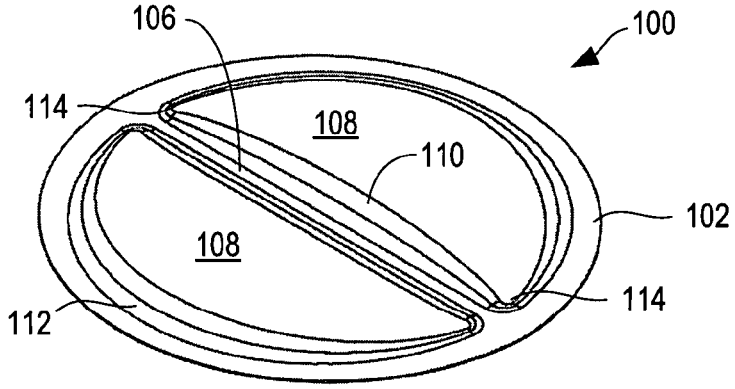
FIG. 1A is a schematic perspective view of an exemplary tray according to various aspects of the invention, having a generally circular shape.

Various aspects of the invention may be illustrated by referring to the figures. For purposes of simplicity, like numerals may be used to describe like features. It will be understood that where a plurality of similar features are depicted, not all of such features necessarily are labeled on each figure. Additionally, it will be understood that where a particular reference character is used to denote a dimension on more than one figure or exemplary embodiment, the reference character may represent any numerical value, and the value may differ for each exemplary embodiment. For example, "L1" may be used to denote a particular length on multiple figures, but each may have a different numerical value in a given embodiment. Further, although several different exemplary aspects, implementations, and embodiments of the various inventions are provided, numerous interrelationships between, combinations thereof, and modifications of the various inventions, aspects, implementations, and embodiments of the inventions are contemplated hereby.

FIGS. 1A-1D depict an exemplary construct, in this example, a disk or tray 100, according to various aspects of the invention. The tray 100 is substantially circular in shape, and is substantially symmetrical along a longitudinal centerline CL and a transverse centerline CT. However, numerous other shapes and configurations are contemplated hereby. For example, the tray may have a triangular, rectangular, square, hexagonal, or any other regular and irregular shape. Likewise, the tray may include no lines of symmetry, a single line of symmetry, or multiple lines of symmetry.

The tray 100 includes a somewhat planar peripheral rim or base 102, and a pair of opposed raised portions or platforms 104 that serve as surfaces for receiving one or more food items (not shown) thereon. The raised portions 104 are separated by a recess 106 that lies substantially within the same plane as the rim 102. In this example, the recess 106 lies along the transverse centerline CT. However, the recess 106 may have any other suitable shape or position, as needed or desired for a particular application.

Figure 1B:
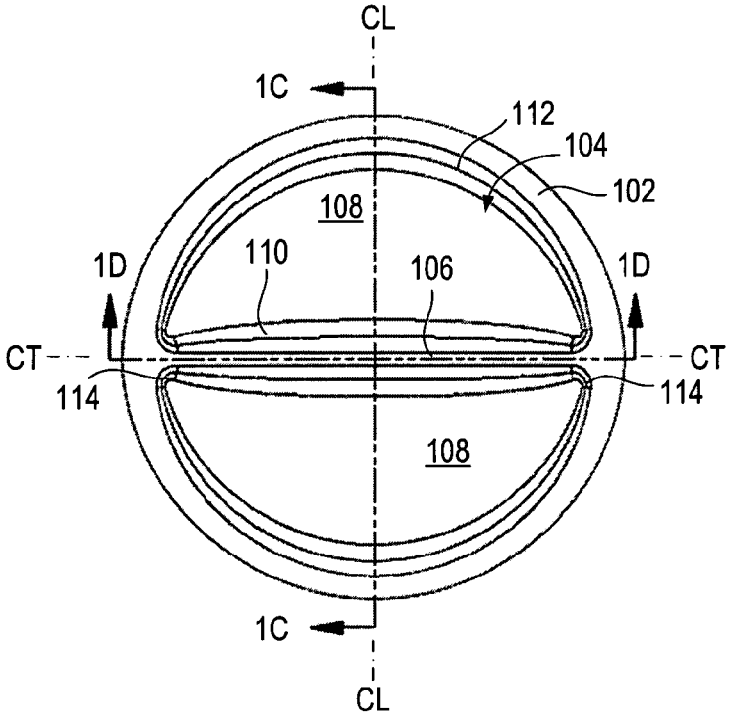
FIG. 1B is a schematic top plan view of the tray of FIG. 1A.

Still viewing FIGS. 1A-1D, each platform 104 is substantially semi-circular in shape, suitable for receiving, for example, a half panini or other sandwich thereon. As best seen in FIGS. 1A and 1B, each platform 104 includes a top surface or face 108 (also referred to as "uppermost surface" and "heating surface"), a somewhat upstanding interior face 110, a somewhat upstanding exterior face 112, and a pair of opposed corner faces 114. It will be understood that, in this and other aspects of the invention, the various faces 108, 110, 112, and 114 are described as being individual faces or surfaces merely for purposes of simplicity and ease of description, and that such faces or surfaces may be substantially continuous and without having a defined boundary between them. Furthermore, it will be understood that the platform may have any desired shape, and that numerous other regular and irregular shapes are contemplated hereby.

In this example, the interior face 110 and the exterior face 112 of each platform 104 extends obliquely, sloping outwardly and downwardly, and tapers in height from the top face 108 towards the recess 106 or rim 102, respectively. Likewise, corner faces 114 slope outwardly and downwardly from the top face 108 towards the recess 106 and/or rim 102, such that the corner face 114 has a generally rounded or convex shape. However, in this and other aspects, it is contemplated that the various faces that define the platform in accordance with the invention may be substantially upright, or may taper inwardly and downwardly from the platform, if needed or desired for a particular application.

Figure 1C:
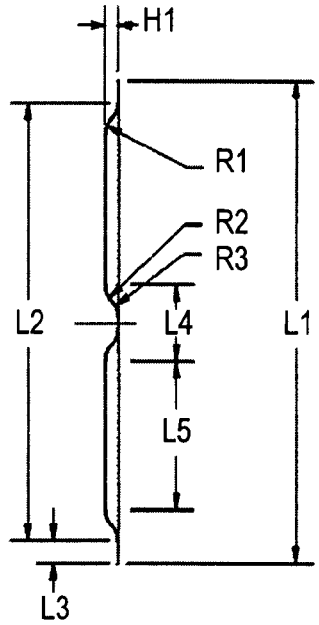
FIG. 1C is a schematic cross-sectional view of the tray of FIG. 1B taken along a line 1C-1C.
Figure 1D:
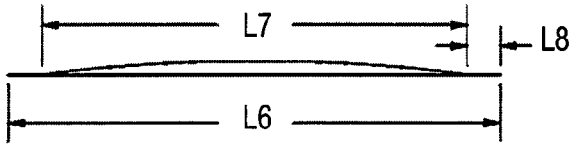
FIG. 1D is a schematic cross-sectional view of the tray of FIG. 1B taken along a line 1D-1D.

If desired, one or both platforms 104 may be contoured to conform generally to the shape of a food item. In this example, each platform 104 is uniform in height H1 when viewed along the longitudinal centerline CL of the tray 100, as shown in FIG. 1C, and is bowed or crowned when viewed along the interior face 110 of the platform 104, as shown in FIG. 1D, such that the platform 104 and therefore, the top surface 108, decreases in height, from the longitudinal centerline CL towards each of the corner faces 114. Such a tray 100 may be particularly well-suited for use with food items that have a somewhat bowed shape, such as frozen dough based food items (e.g., sandwiches, pizzas, etc.).

The tray 100 may be characterized as having various heights, for example, H1, lengths, for example, L1, L2, L3, L4, L5, L6, L7, and L8, and radii of curvature, for example, R1, R2, and R3, each of which may vary for a particular application. The dimensions of each platform 104 may be substantially identical, such that the tray 100 is substantially symmetrical across each side of the longitudinal centerline CL, or may differ, such that the tray 100 is not symmetrical across each side of the longitudinal centerline CL. Likewise, the dimensions of each platform 104 may be substantially identical, such that the tray 100 is substantially symmetrical across each side of the transverse centerline CT, or may differ, such that the tray 100 is not symmetrical across each side of the transverse centerline CT.

If desired, any of the various trays of the invention may include features that alter the effect of microwave energy during the heating or cooking of the food item. For example, any of the trays may be formed at least partially from one or more microwave energy interactive elements (sometimes referred to as "microwave interactive elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item, as will be discussed in greater detail below. As a matter of convenience and not limitation, and although it is understood that a microwave interactive element supported on a microwave transparent substrate includes both microwave interactive and microwave inactive elements or components, such structures may be referred to herein as "microwave interactive webs".

In one example, the microwave interactive element may comprise a thin layer of microwave interactive material that tends to absorb microwave energy, thereby generating heat at the interface with a food item. Such elements often are used to promote browning and/or crisping of the surface of a food item. When supported on a film or other substrate, such an element may be referred to collectively with the substrate as a "susceptor film" or sometimes, simply, "susceptor".

Figure 1E:
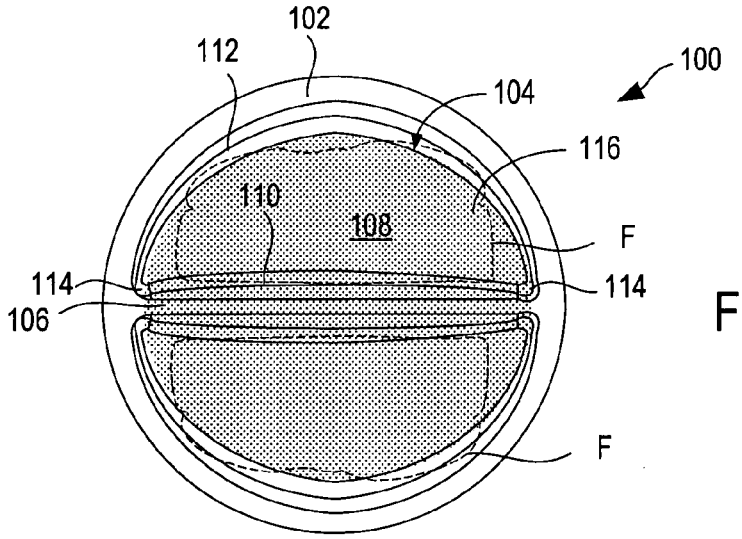
FIG. 1E is a schematic top plan view of the tray of FIGS. 1A-1D including a microwave energy interactive element, according to various aspects of the invention.

For example, as schematically shown in FIG. 1E by stippling, a microwave energy interactive element 116, for example, a susceptor, may overlie all or a portion of each platform 104, including all or a portion of the top surface 108, recess 106, interior face 110, and/or corner faces 114 of one or both platforms 104. A susceptor or other microwave energy interactive element also may overlie all or a portion of exterior face 112.

Where the susceptor is supported on a polymer film, it will be understood that the polymer film substrate may overlie additional portions or substantially the entire tray, with the microwave energy interactive element (i.e., the susceptor) positioned between the substrate and the particular tray component in the desired location to heat, brown, and/or crisp the food item. In this manner, a tray according to the invention can be pressed or otherwise formed from a multilayer structure comprising the susceptor film joined to the material used to form the tray.

To use the tray, one or more food items F (shown schematically with dashed lines in FIG. 1E) typically are placed on each platform and placed into a microwave oven (not shown). In one particular example, the food item is a sandwich that has been separated into two sections, each including a piece of bread and one or more toppings in an "open face" configuration. In another particular example, the food item is a pizza, which has been separated into, or provided as, two separate pieces, slices, or portions. In yet another example, the food item is a single item, for example, a pizza, that has not been divided into separate pieces, slices, or portions. In such an example, the pizza may overlie both platforms and the recess therebetween. Alternatively, it is contemplated that the tray may include a single platform having a generally circular shape to accommodate the doming of circular pizza. In this instance, the platform may have an overall domed configuration, such that the height of the platform decreases in any direction from the center of the platform outwardly towards the base of the tray. Alternatively still, it is contemplated that the tray may include a plurality of platforms, each intended to receive one or more of a plurality of items, or one or more portions of a plurality of items, to be heated.

In any case, the food items are positioned on the heating surface 108 of each platform 104 with the surface to be browned and/or crisped, for example, the bread or pizza crust, adjacent to the tray 100. The contoured heating surface 108 of the platform 104 generally accommodates the contoured surface of the food item, which often is prone to bowing during the freezing process, and brings the susceptor into closer proximity to the surface of the food item to be browned and/or crisped.

It is noted that, with any of the numerous trays contemplated hereby, the food item or items may be slightly larger than the respective platform, in this example, platform 104, and therefore, the food may extend slightly beyond the "boundaries" of the heating surface, in this example, top face 108. As the food item thaws, any such portion of the food item extending beyond the heating surface may flex downwardly and be brought into proximate and/or intimate contact with the various upstanding faces of the platform, for example, faces 110, 112, and/or 114. Where a microwave energy interactive element, for example, a susceptor, overlies such faces, the faces may serve as heating surfaces to enhance browning and/or crisping of the corresponding portions of the food item.

As the microwave heating cycle progresses, the susceptor converts microwave energy to thermal energy, which then is transferred to the adjacent surface of the food item. In this manner, the browning and/or crisping of the surface of the food item can be enhanced. Furthermore, platforms 104 maintain the food item in a position elevated from the floor or turntable of the microwave oven, which reduces the amount of sensible heat transferred from the susceptor to the ambient environment of the microwave oven and further enhances browning and/or crisping.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of tray or other construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the tray that is microwave energy inactive by deactivation or otherwise, or one that is otherwise transparent to microwave energy. Thus, for example, the aperture may be a portion of the tray formed without a microwave energy active material or, alternatively, may be a portion of the tray formed with a microwave energy active material that has been deactivated. While both physical and non-physical apertures allow the food item to be heated directly by the microwave energy, a physical aperture also provides a venting function to allow steam or other vapors to be released from the food item.

FIGS. 2-5 illustrate numerous examples of microwave energy interactive trays according to the invention that include one or more discontinuities in the microwave energy interactive element. The various trays 200, 300, 400, and 500 include features that are similar to tray 100 shown in FIGS. 1A-1E, except for variations noted and variations that will be understood by those of skill in the art. For simplicity, the reference numerals of similar features are preceded in the figures with a "2" (FIG. 2), "3" (FIG. 3), "4" (FIG. 4), or "5" (FIG. 5) instead of a "1".

Figure 2:
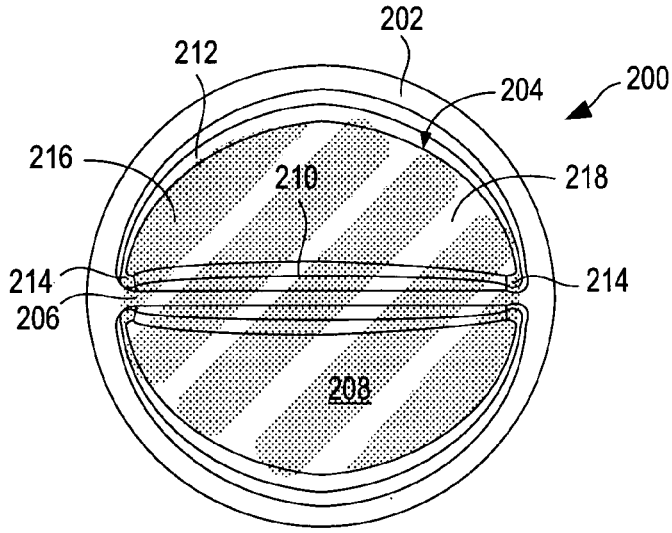
FIG. 2 is a schematic top plan view of another exemplary tray according to various aspects of the invention, similar to the tray of FIGS. 1A-1D, including a microwave energy interactive element having a patterned configuration.

In the example shown in FIG. 2, the microwave energy interactive element 216 comprises a plurality of spaced susceptor bands or stripes (shown by stippling) extending obliquely across the transverse centerline CL of the tray 200, with microwave inactive or transparent areas 218 therebetween. The bands may have any width, orientation, and configuration as desired. When used to heat a food item, the microwave energy interactive bands may form a corresponding plurality of darkened areas on the outer surface of the food item. Such marks may resemble grill marks, such as with a panini grill.

In this and other aspects of the invention, it will be understood that the arrangement of microwave energy interactive and microwave energy transparent areas may be selected to provide various levels of heating, as needed or desired for a particular application. For example, where greater heating is desired, the total inactive area may be increased. In doing so, more microwave energy is transmitted to the food item. Alternatively, by decreasing the total inactive area, more microwave energy is absorbed by the microwave energy interactive areas, converted into thermal energy, and transmitted to the surface of the food item to enhance browning and/or crisping.

Figure 3:
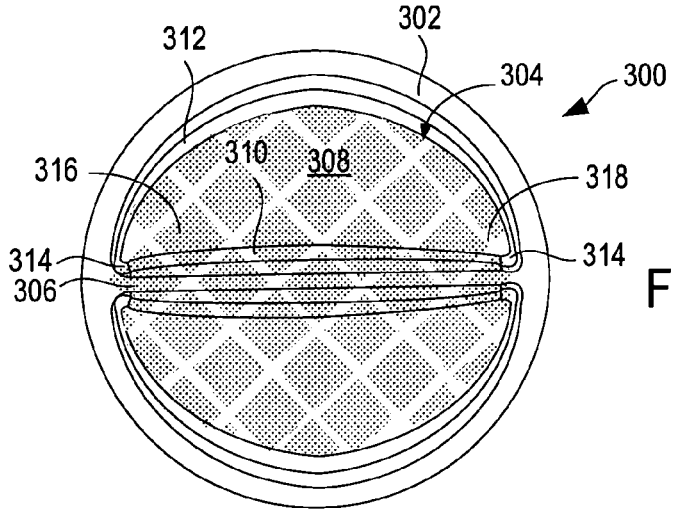
FIG. 3 is a schematic top plan view of yet another exemplary tray according to various aspects of the invention, similar to the tray of FIGS. 1A-1D, including a microwave energy interactive element having a patterned configuration.

In the example shown in FIG. 3, the microwave energy interactive element 316 comprises a plurality of substantially uniformly spaced susceptor squares (shown by stippling) with a grid-like arrangement of microwave energy transparent areas 318 therebetween. It will be understood that the dimensions of the susceptor squares and the spaces therebetween may vary for a particular application. Furthermore, it will be understood that the susceptor elements need not be in the shape of a square. Other shapes are contemplated hereby. In this example, the pattern of browning on the exterior surface of a food item may resemble a plurality of substantially uniformly spaced squares.

Figure 4:
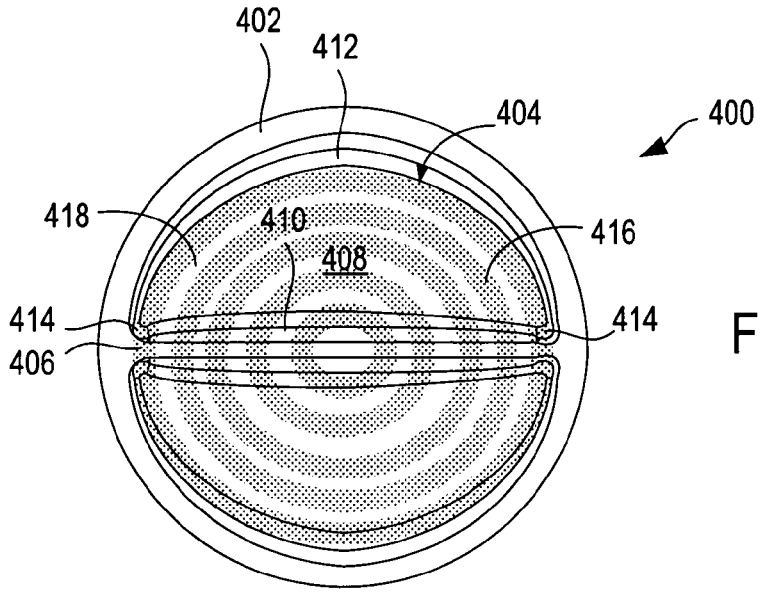
FIG. 4 is a schematic top plan view of still another exemplary tray according to various aspects of the invention, similar to the tray of FIGS. 1A-1D, including a microwave energy interactive element having a patterned configuration.

In the example shown in FIG. 4, the microwave energy interactive element 416 comprises a plurality of concentric susceptor rings (shown by stippling) with microwave energy transparent areas or rings 418 therebetween. In this example, the pattern of browning on the exterior surface of a food item (not shown) may resemble a plurality of substantially uniformly spaced half circles, for example, where each food item overlies only one platform 404, or a plurality of partial concentric circles, for example, where the food item overlies both platforms 404 and extends across recess 406.

Figure 5:
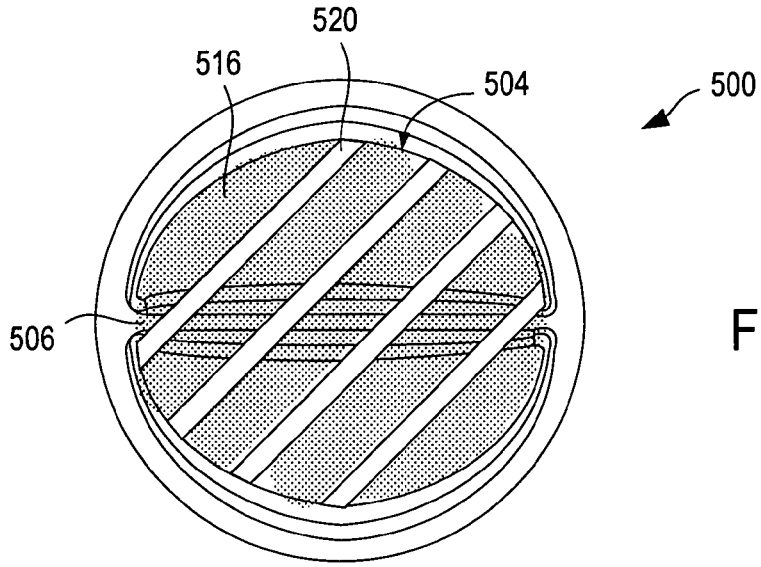
FIG. 5 is a schematic top plan view of still another exemplary tray according to various aspects of the invention, similar to the tray of FIGS. 1A-1E, including a plurality of elongate apertures.

In the example shown in FIG. 5, a plurality of physical apertures 520 extend through the thickness of the tray 500 and interrupt the microwave energy interactive element 516. In this example, the apertures 520 are in the form of elongate slots that extend obliquely across the platforms 504. However, it will be understood that the apertures may have any suitable shape, for example, circular, square, triangular, oval, oblong, or any other regular or irregular shape, may have any suitable configuration, for example, random, tiled, staggered, concentric rings, and may have any suitable placement, for example, central, peripheral, or throughout all or a portion of the tray. In this example, the pattern of browning may include plurality of obliquely oriented, darkened areas on the outer surface of the food item. Such darkened areas may resemble grill marks.

It will be understood that any of the various trays of the invention may include a microwave energy interactive element, for example, a susceptor, that renders the tray microwave energy interactive. In each embodiment, the microwave energy interactive element may be substantially continuous, may have one or more interruptions or discontinuities. Such interruptions or discontinuities may include non-physical apertures and/or physical (venting) apertures, for example, as shown in FIGS. 2-5, or may have any other pattern, arrangement, or configuration. It will be understood that the precise combination of features may be selected as needed or desired to enhance the heating, browning, and/or crisping of a particular food item. While such elements may be discussed below in connection with some of the various trays of the invention, such elements are not shown in the remaining figures.

Alternatively or additionally, any of the various trays of the invention may include one or more venting channels that allow moisture to escape from the food item, thereby further enhancing the heating, browning, and/or crisping of the food item.

For example, FIGS. 6A-6D schematically illustrate still another exemplary disk or tray 600 according to various aspects of the invention. The tray 600 includes features that are similar to tray 100 shown in FIGS. 1A-1D, except for variations noted and variations that will be understood by those of skill in the art. For simplicity, the reference numerals of similar features are preceded in the figures with a "6" instead of a "1".

In this example, a pair of substantially parallel channels 616 (or "grooves" or "indentations") extends across the top face 608 of each platform 604 between, and optionally through one or both of, the interior face 608 and the exterior face 612. In this example, the channels 616 are substantially parallel to and substantially evenly spaced about the longitudinal centerline CL, and substantially perpendicular to the transverse centerline CT. However, the channels may have any orientation needed or desired for a particular application. In this and other examples described herein or contemplated hereby, the channels may have any suitable depth as needed to provide the desired degree of ventilation for the particular heating application. In one aspect, the channels have a depth that is less than the height of the top face, such that the bottom of at least one channel lies above the plane of the rim and/or recess of the tray.

Figure 6A:
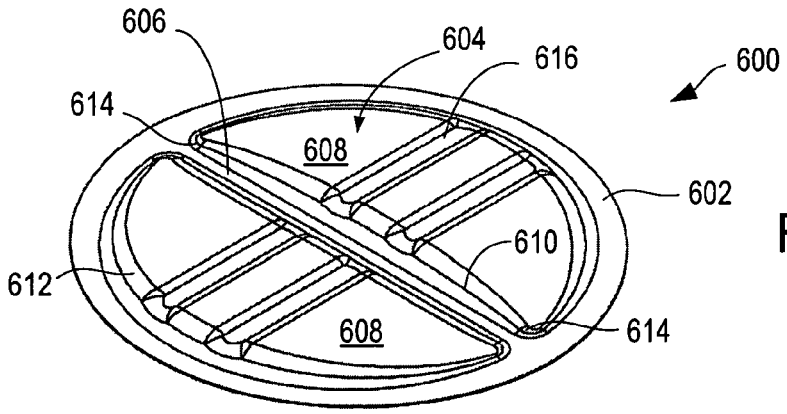
FIG. 6A is a schematic perspective view of another exemplary tray according to various aspects of the invention, including a plurality of channels.
Figure 6B:
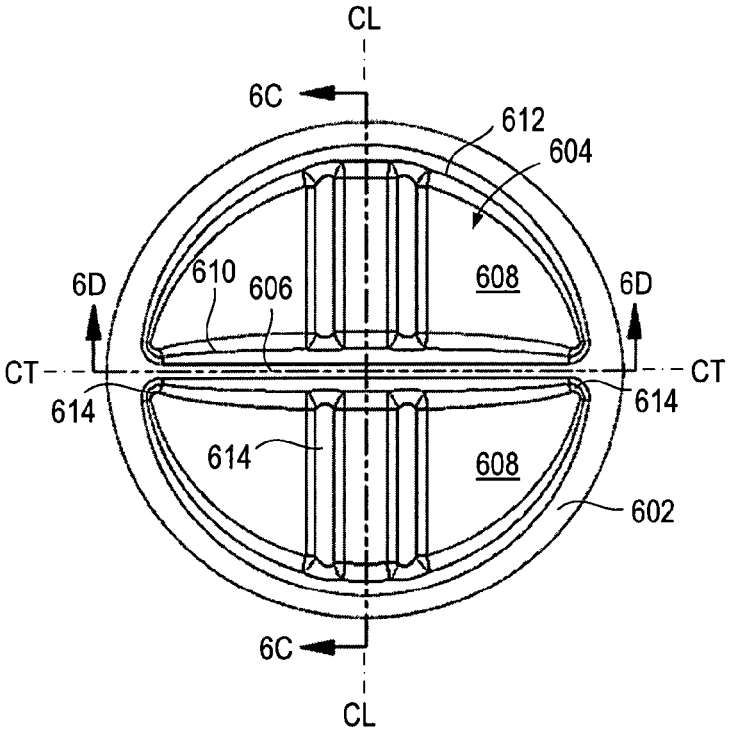
FIG. 6B is a schematic top plan view of the tray of FIG. 6A.
Figure 6C:
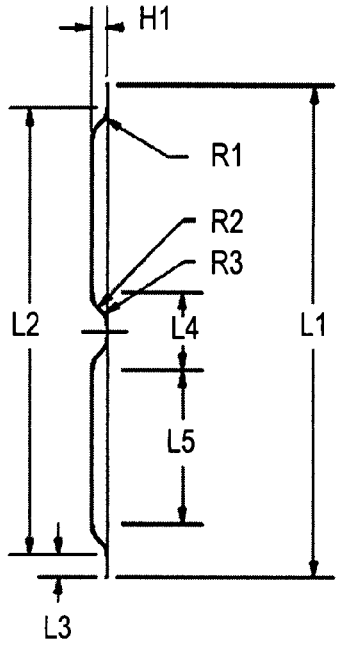
FIG. 6C is a schematic cross-sectional view of the tray of FIG. 6B taken along a line 6C-6C.
Figure 6D:
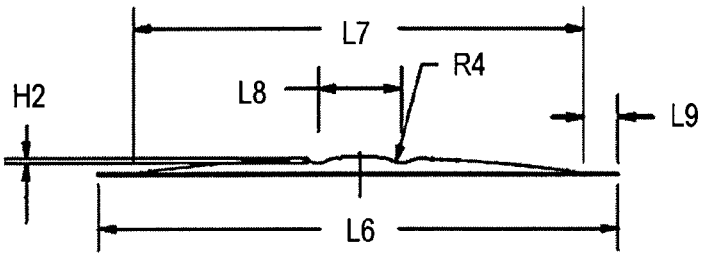
FIG. 6D is a schematic cross-sectional view of the tray of FIG. 6B taken along a line 6D-6D.
Figure 7A:
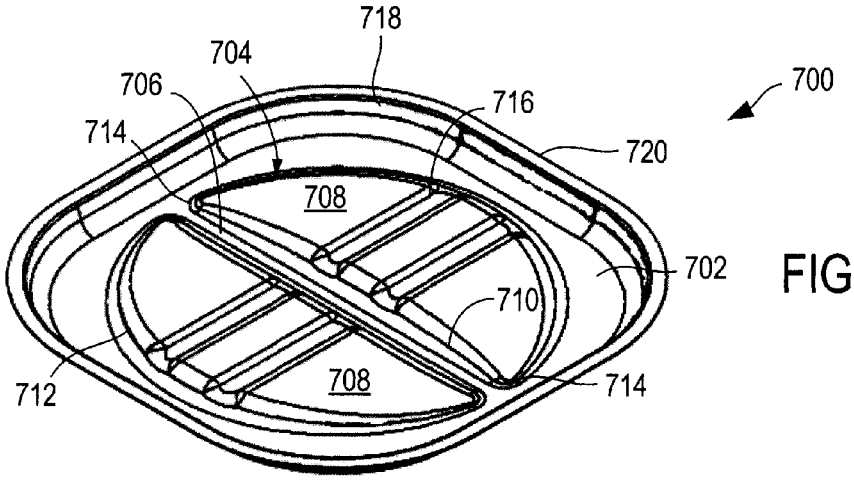
FIG. 7A is a schematic perspective view of an exemplary variation of the tray of FIGS. 6A-6D according to various aspects of the invention, including a plurality of side walls.
Figure 7B:
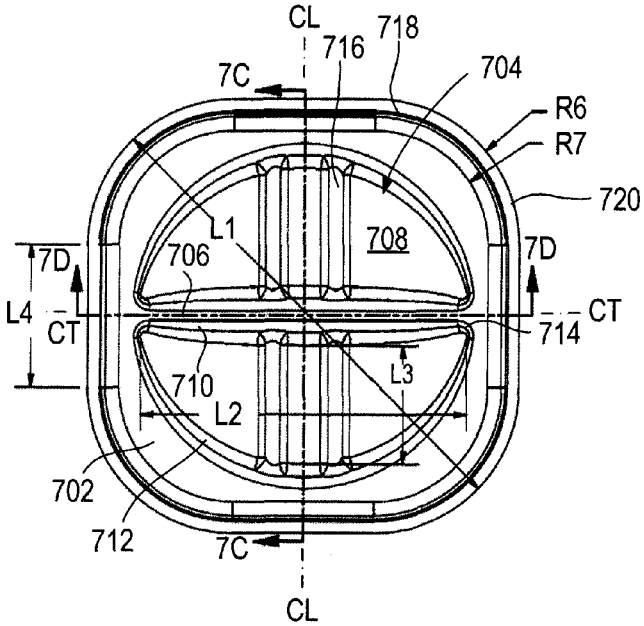
FIG. 7B is a schematic top plan view of the tray of FIG. 7A.
Figure 7C:
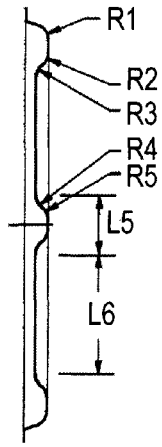
FIG. 7C is a schematic cross-sectional view of the tray of FIG. 7B taken along a line 7C-7C.
Figure 7D:
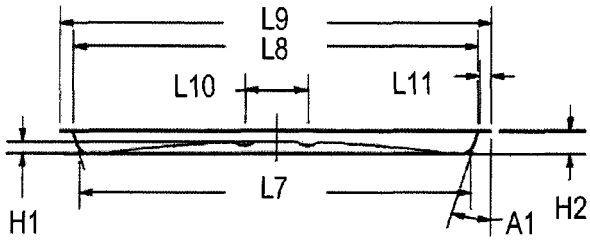
FIG. 7D is a schematic cross-sectional view of the tray of FIG. 7B taken along a line 7D-7D.
Figure 8A:
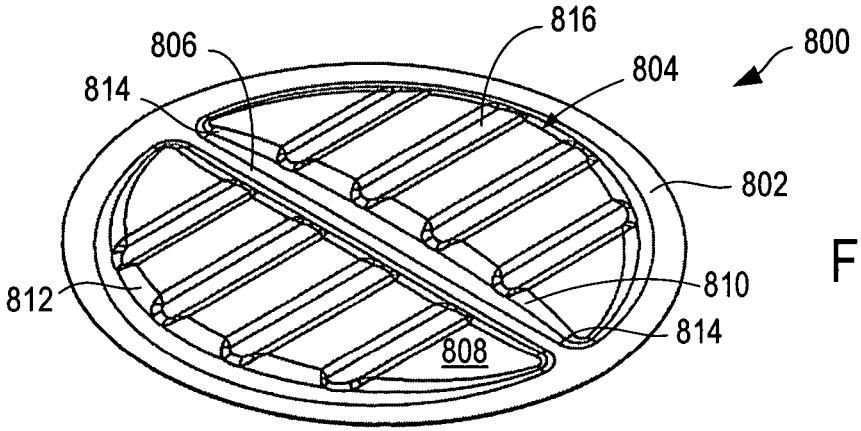
FIG. 8A is a schematic perspective view of an exemplary variation of the tray of FIGS. 6A-6D according to various aspects of the invention, including additional channels.
Figure 8B:
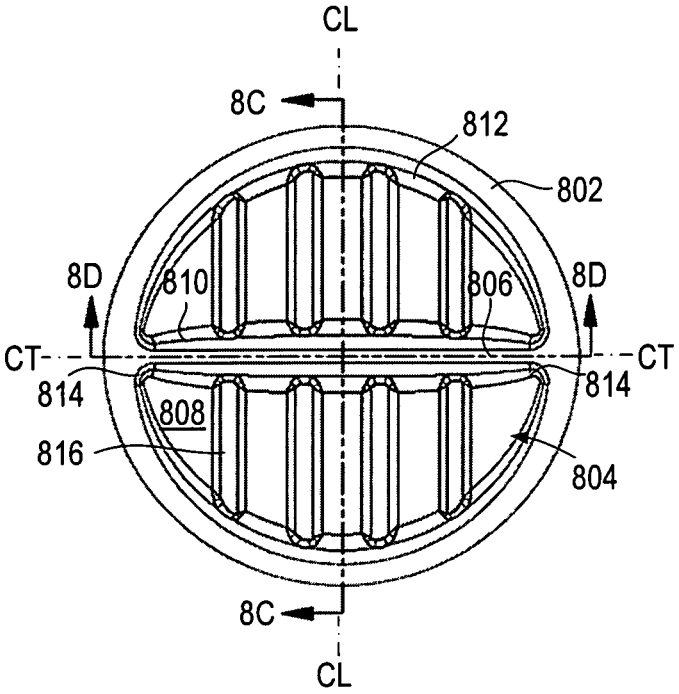
FIG. 8B is a schematic top plan view of the tray of FIG. 8A.
Figure 8C:
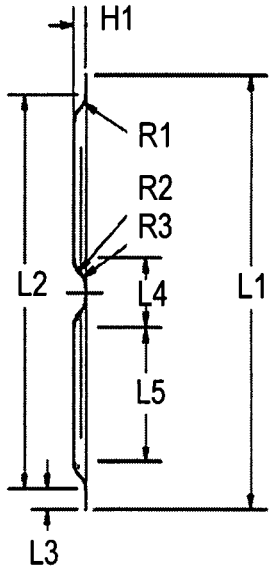
FIG. 8C is a schematic cross-sectional view of the tray of FIG. 8B taken along a line 8C-8C.
Figure 8D:
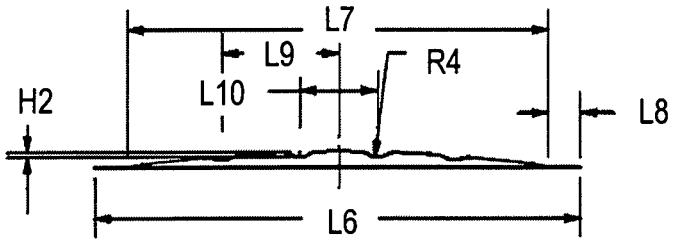
FIG. 8D is a schematic cross-sectional view of the tray of FIG. 8B taken along a line 8D-8D.

If desired, one or both platforms 604 may be contoured to conform generally to the shape of a food item. In this example, the height H1 of each platform 604 is substantially uniform when viewed along the longitudinal centerline CL of the tray 600, as shown in FIG. 6C, and varies in height when viewed along the interior face 610 of the platform 604, as shown in FIG. 6D. In this example, the height of the platform 604, and therefore the height of the top face 608, tapers or decreases when viewed from the longitudinal centerline CL toward the each of the corner faces 610. However, other shapes and contours are contemplated.

The tray 600 may be characterized as having various heights, for example, H1 and H2, lengths, for example, L1, L2, L3, L4, L5, L6, L7, L8, and L9, and radii of curvature, for example, R1, R2, R3, and R4, each of which may vary for a particular application. The dimensions of each platform 604 may be substantially identical or may differ, with various degrees of symmetry being contemplated hereby.

If desired, a microwave energy interactive element (not shown) may overlie and may be joined to at least a portion of the tray 600. For example, a susceptor (not shown) may overlie all or a portion of one or both platforms 604, including all or a portion of each top face 608, interior face 610, exterior face 612, and/or corner face 614, all or a portion of recess 606, and/or all or a portion of one or more of channels 616.

To use the tray 600, one or more food items (not shown) typically are placed on each platform and placed into a microwave oven (not shown). The contoured heating surface 608 of the platform 604 generally accommodates the contoured surface of the food item, which may vary as a result of the freezing process, and brings the susceptor into closer proximity to the surface of the food item to be browned and/or crisped.

As the microwave heating cycle proceeds, the susceptor converts microwave energy to thermal energy, which then is transferred to the adjacent surface of the food item. In this manner, the browning and/or crisping of the surface of the food item may be enhanced. At least some of any steam released from the food item may be carried away from the food item along channels 616, thereby further enhancing browning and/or crisping. Additionally, platforms 604 maintain the food item in an elevated position, which reduces the amount of sensible heat transferred from the susceptor to the ambient environment of the microwave oven, still further enhancing the browning and/or crisping of the food item. The pattern of browning and/or crisping may include an overall darkened appearance with somewhat lighter areas corresponding to the areas overlying channels 616.

FIGS. 7A-7D schematically depict still another exemplary tray 700 according to various aspects of the invention. The tray 700 includes features that are similar to tray 100 shown in FIGS. 1A-1D and tray 600 shown in FIGS. 6A-6D, except for variations noted and variations that will be understood by those of skill in the art. For simplicity, the reference numerals of similar features are preceded in the figures with a "7" instead of a "1" or "6", respectively.

In this example, the tray 700 includes a plurality of walls 718 extending substantially upwardly from the rim or flange 702, which serves as a base or lowermost portion of the tray 700. If desired, the walls 718 may be terminated with a lip 720. If desired, a microwave energy interactive element (not shown) may overlie and may be joined to at least a portion of the tray 700. For example, a susceptor (not shown) may overlie all or a portion of one or both platforms 704, including all or a portion of each top face 708, interior face 710, exterior face 712, and/or corner face 714, all or a portion of recess 706, and/or all or a portion of one or more of channels 716. Such a tray 700 may be suitable for use, for example, where the food item to be heated, browned, and/or crisped includes components that may otherwise fall from a tray without walls, or where it is desired that the tray serve as a container from which the food item is consumed.

The tray 700 may be characterized as having various heights, for example, H1 and H2, lengths, for example, L1, L2, L3, L4, L5, L6, L7, L8, L9, L10, and L11, radii of curvature, for example, R1, R2, R3, R4, R5, R6, and R7, and angles, for example, A1, each of which may vary for a particular application. The specifications of each platform 704 may be substantially identical or may differ, with various degrees of symmetry being contemplated hereby.

FIGS. 8A-8D schematically illustrate another exemplary disk or tray 800 according to various aspects of the invention. The tray 800 includes features that are similar to tray 100 shown in FIGS. 1A-1D and tray 600 shown in FIGS. 6A-6D, except for variations noted and variations that will be understood by those of skill in the art. For simplicity, the reference numerals of similar features are preceded in the figures with an "8" instead of a "1" or "6", respectively.

In this example, the tray 800 includes four substantially parallel channels 816 or indentations extending across the top face 808 of each platform 804, and optionally through one or both of, the interior face 810 and the exterior face 812. Such additional channels 816 may be desirable where additional venting is needed to attain the desired degree of browning and/or crisping of a food item prepared thereon. The channels 816 may have any suitable depth as needed to provide the desired degree of ventilation for the particular heating application.

The tray 800 may be characterized as having various heights, for example, H1 and H2, lengths, for example, L1, L2, L3, L4, L5, L6, L7, L8, L9, and L10, and radii of curvature, for example, R1, R2, R3, and R4 each of which may vary for a particular application. The dimensions of each platform 804 may be substantially identical or may differ, with various degrees of symmetry being contemplated hereby.

As with the various other exemplary trays of the invention, a microwave energy interactive element (not shown) may overlie and may be joined to at least a portion of the tray 800. For example, a susceptor (not shown) may overlie all or a portion of one or both platforms 804, including all or a portion of each top face 808, interior face 810, exterior face 812, and/or corner face 814, all or a portion of recess 806, and/or all or a portion of one or more of channels 816. The resulting pattern of browning and/or crisping may include an overall darkened appearance with somewhat lighter areas corresponding to the areas overlying channels 816, generally resembling grill marks.

FIGS. 9A-9E schematically depict another exemplary tray 900 according to various aspects of the invention. The tray 900 includes features that are similar to tray 100 (FIGS. 1A-1D), tray 600 (FIGS. 6A-6D), and tray 800 (FIGS. 8A-8D), except for variations noted and variations that will be understood by those of skill in the art. For simplicity, the reference numerals of similar features are preceded in the figures with a "9" instead of a "1", "6", or "8", respectively.

In this example, the tray 900 includes four substantially parallel channels 916 or indentations extending obliquely across the top face 908 of each platform 904, and optionally through one or both of, the interior face 910 and the exterior face 912. Such additional channels 916 may be desirable where additional venting is needed to attain the desired degree of browning and/or crisping of a food item prepared thereon.

The tray 900 may be characterized as having various heights, for example, H1 and H2, lengths, for example, L1, L2, L3, L4, L5, L6, L7, and L8, and radii of curvature, for example, R1, R2, R3, and R4 each of which may vary for a particular application. The dimensions of each platform 904 may be substantially identical or may differ, with various degrees of symmetry being contemplated hereby.

If desired, a microwave energy interactive element (not shown) may overlie and may be joined to at least a portion of the tray 900. For example, a susceptor (not shown) may overlie all or a portion of one or both platforms 904, including all or a portion of each top face 908, interior face 910, exterior face 912, and/or corner face 914, all or a portion of recess 906, and/or all or a portion of one or more of channels 916. The resulting pattern of browning and/or crisping may include an overall darkened appearance with somewhat lighter, obliquely oriented areas corresponding to the areas overlying channels 916, generally resembling grill marks.

FIGS. 10A-10D schematically illustrate another exemplary tray 1000 according to various aspects of the invention. The tray 1000 includes features that are similar to tray 100 (FIGS. 1A-1D), tray 600 (FIGS. 6A-6D), and tray 800 (FIGS. 8A-8D), except for variations noted and variations that will be understood by those of skill in the art. For simplicity, the reference numerals of similar features are preceded in the figures with a "10" instead of a "1", "6", or "8", respectively.

Figure 10A:
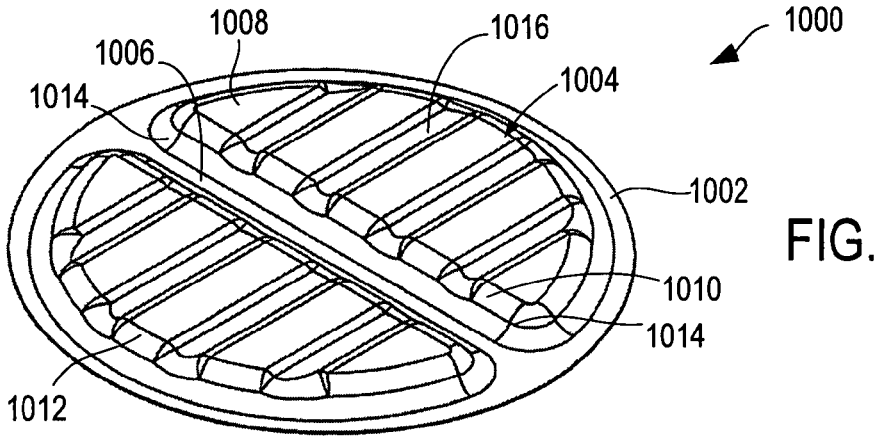
FIG. 10A is a schematic perspective view of an exemplary variation of the tray of FIGS. 8A-8D according to various aspects of the invention, including a substantially planar heating surface.
Figure 10B:
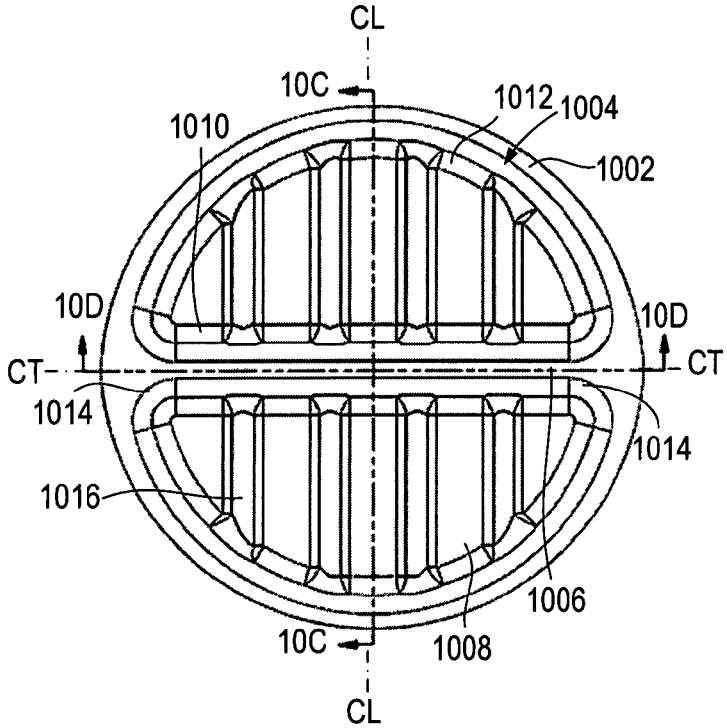
FIG. 10B is a schematic top plan view of the tray of FIG. 10A.
Figure 10C:
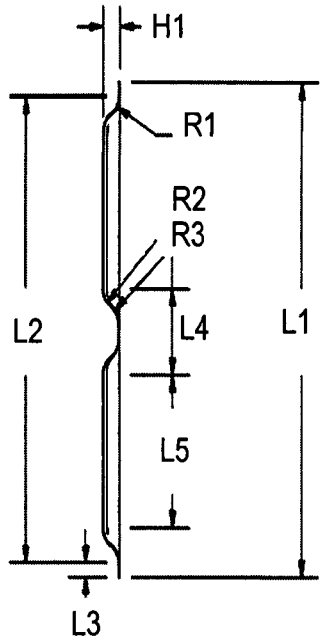
FIG. 10C is a schematic cross-sectional view of the tray of FIG. 10B taken along a line 10C-10C.
Figure 10D:
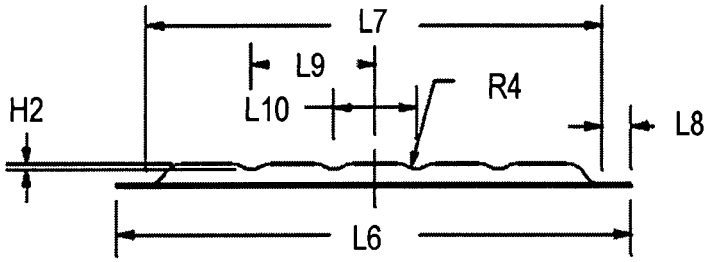
FIG. 10D is a schematic cross-sectional view of the tray of FIG. 10B taken along a line 10D-10D.

In this example, the platforms 1004 have a substantially planar top face 1008, as best seen in FIGS. 10C and 10D. Such a tray 1000 may be particularly well-suited for use with food items that have a substantially planar surface.

The tray 1000 may be characterized as having various heights, for example, H1 and H2, lengths, for example, L1, L2, L3, L4, L5, L6, L7, L8, L9, and L10, and radii of curvature, for example, R1, R2, R3, and R4, each of which may vary for a particular application.

FIGS. 11A-11E schematically illustrate yet another exemplary tray 1100 according to various aspects of the invention. The tray 1100 is substantially symmetrical along a longitudinal centerline CL and a transverse centerline CT. However, the tray may include no lines of symmetry, a single line of symmetry, or multiple lines of symmetry, as needed or desired for a particular application.

In this example, the tray 1100 is substantially square in shape with somewhat rounded corners 1102. The tray 1100 includes a somewhat planar peripheral rim or base 1104, which serves as a base or lowermost portion of the tray 1100, and a plurality of walls 1106 extending substantially upwardly from the rim 1104. If desired, the walls 1106 may be terminated with a lip 1108. Such a tray 1100 may be suitable for use, for example, where the food item to be heated, browned, and/or crisped includes components that may otherwise fall from a tray without walls, or where it is desired that the tray serve as a container from which the food item is consumed.

The tray 1100 includes a pair of opposed raised portions or platforms 1110 that serve as surfaces for receiving one or more food items (not shown) thereon. The platforms 1110 are separated by a recess 1112 that lies substantially within the same plane as the rim 1104. In this example, the recess 1112 lies along the transverse centerline CT. However, the recess 1112 may have any other suitable position, as needed or desired for a particular application. The platforms 1110 optionally may be separated further by a divider 1114 extending upwardly along at least a portion of the length of the recess 1112. The divider 1114 may assist the user with proper placement of the food items on the tray 1100 to achieve the desired level heating, browning, and/or crisping, and may assist with maintaining the food items in the proper location on the tray 1100 during the heating cycle.

Still viewing FIGS. 11A-11D, the platforms 1110 are somewhat elongate and rectangular in shape with rounded corners 1116. Each platform 1110 includes a top surface or face 1118 (also referred to as "uppermost surface" and "heating surface"), a somewhat upstanding interior face 1120, a somewhat upstanding exterior face 1122, and a pair of opposed corner faces 1124. It will be understood that, in this and other aspects of the invention, the various faces 1118, 1120, 1122, and 1124 are described as being individual faces or surfaces merely for purposes of simplicity and ease of description, and that such faces or surfaces may be substantially continuous and without having a defined boundary between them.

Figure 11A:
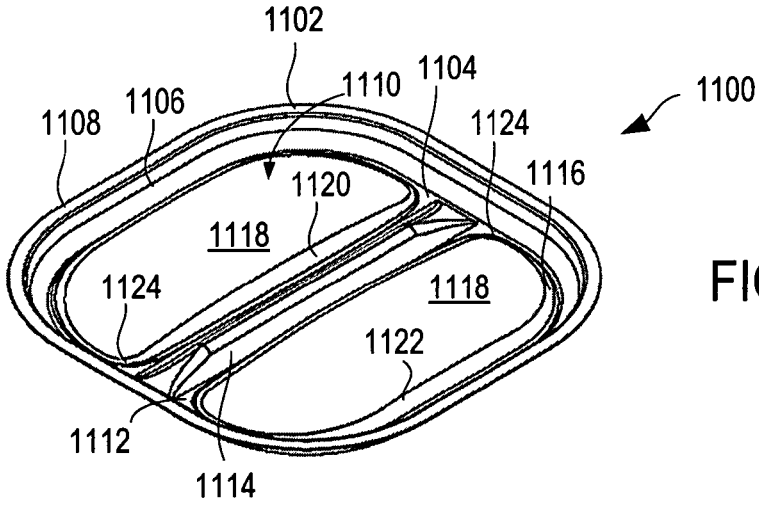
FIG. 11A is a schematic perspective view of another exemplary tray according to various aspects of the invention, having a generally square shape.
Figure 11B:
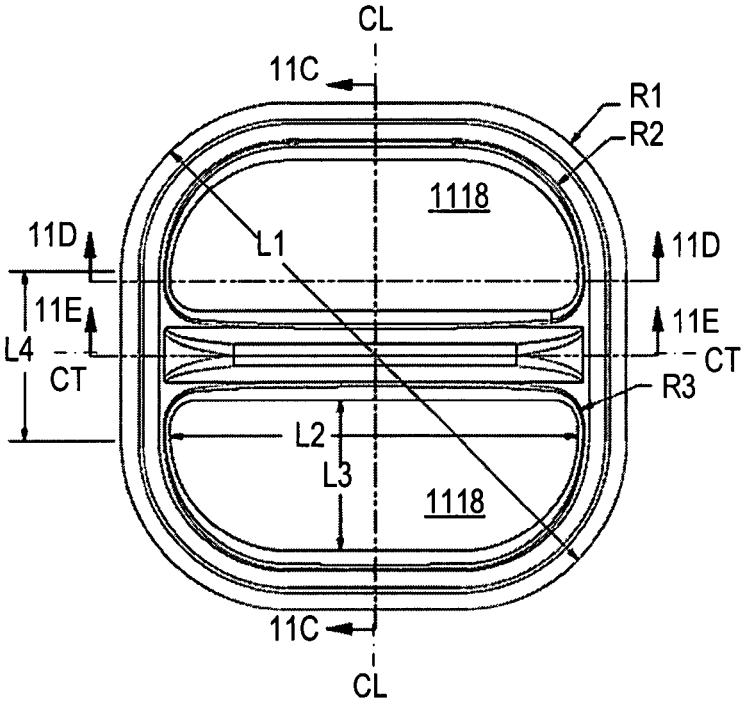
FIG. 11B is a schematic top plan view of the tray of FIG. 11A.
Figure 11C:
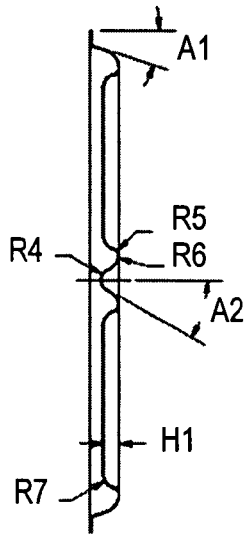
FIG. 11C is a schematic cross-sectional view of the tray of FIG. 11B taken along a line 11C-11C.

As shown in FIG. 11B, the shape of the exterior surface 1122 in top plan view generally corresponds to or "tracks" the shape of the upstanding walls 1106. The interior face 1120 and exterior face 1122 of each platform 1110 extend obliquely or slope, outwardly and downwardly, from the respective platform 1110 towards the recess 1112 or rim 1104, respectively, as best seen in FIG. 11C. However, in this and other aspects, it is contemplated that the various faces that form the platform in accordance with the invention may be substantially upright, or may taper inwardly and downwardly from the platform, if needed or desired for a particular application.

Figure 11D:
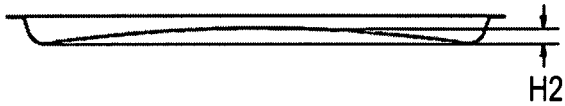
FIG. 11D is a schematic cross-sectional view of the tray of FIG. 11B taken along a line 11D-11D.
Figure 11E:
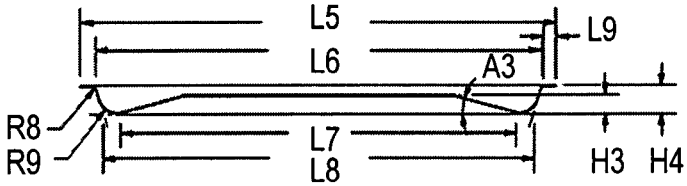
FIG. 11E is a schematic cross-sectional view of the tray of FIG. 11B taken along a line 11E-11E.
Figure 12A:
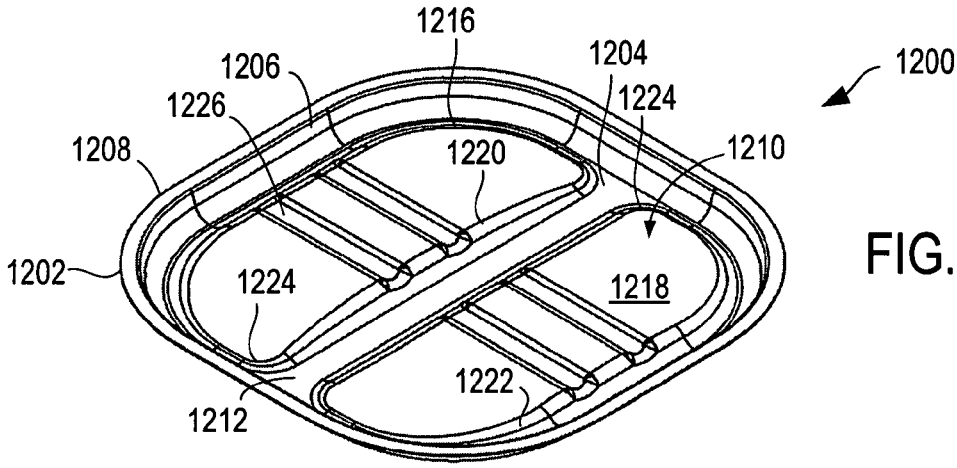
FIG. 12A is a schematic perspective view of a variation of the tray of FIGS. 11A-11E according to various aspects of the invention, including a plurality of channels.
Figure 12B:
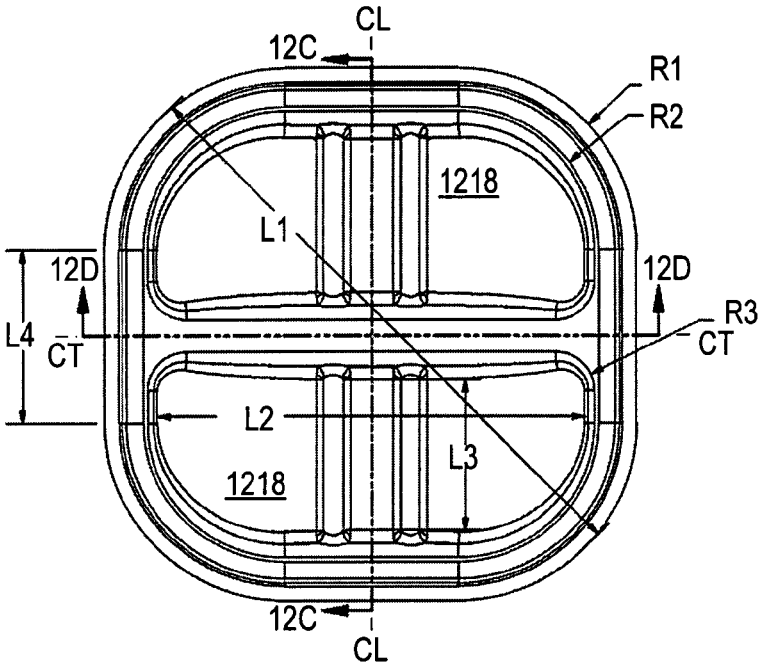
FIG. 12B is a schematic top plan view of the tray of FIG. 12A.
Figure 12C:
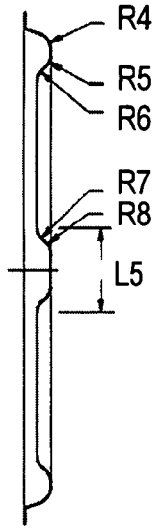
FIG. 12C is a schematic cross-sectional view of the tray of FIG. 12B taken along a line 12C-12C.
Figure 12D:
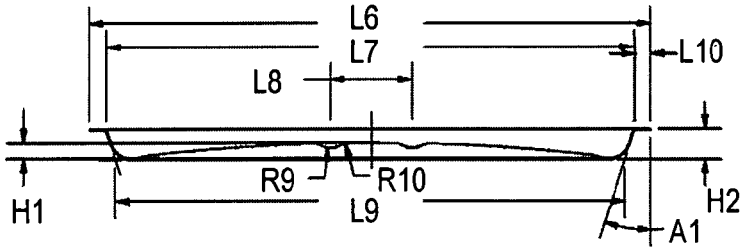
FIG. 12D is a schematic cross-sectional view of the tray of FIG. 12B taken along a line 12D-12D.

If desired, one or both platforms 1110 may be contoured to conform generally to the shape of a food item. In this example, the thickness of each platform 1110, and therefore the height H1 of each top face 1118, is substantially uniform when viewed along the longitudinal centerline CL of the tray 1100, as shown in FIG. 11C, and varies in height when viewed along the interior face 1120 of the platform 1110, as shown in FIG. 11D. In this example, the thickness of the platform 1110, and therefore the height of the top face 1118, decreases or tapers from the longitudinal centerline CL toward the each of the corner faces 1124.

The tray 1100 may be characterized as having various heights, for example, H1, H2, H3, and H4, lengths, for example, L1, L2, L3, L4, L5, L6, L7, L8, and L9, radii of curvature, for example, R1, R2, R3, R4, R5, R6, R7, R8, and R9, and angles, for example, A1, A2, and A3, each of which may vary for a particular application. The dimensions of each platform 1110 may be substantially identical, such that the tray 1100 is substantially symmetrical across each side of the longitudinal centerline CL and/or the transverse centerline CT, or may differ, such that the tray 1100 is not symmetrical across each side of the longitudinal centerline CL and/or the transverse centerline CL.

If desired, a microwave energy interactive element (not shown) may overlie and may be joined to at least a portion of the tray 1100. For example, a susceptor (not shown) may overlie all or a portion of one or both platforms 1110, including all or a portion of each top face 1118, interior face 1120, exterior face 1122, and/or corner face 1124, and/or all or a portion of recess 1112.

FIGS. 12A-12D schematically depict still another exemplary tray 1200 according to various aspects of the invention. The tray 1200 includes some features that are similar to tray 1100 shown in FIGS. 11A-11D, except for variations noted and variations that will be understood by those of skill in the art. For simplicity, the reference numerals of similar features are preceded in the figures with a "12" instead of an "11".

In this example, a pair of substantially parallel venting channels 1226 extends across the top face 1218 of each platform 1210, and optionally through one or both of, the interior face 1220 and the exterior face 1222. The channels 1226 may have any suitable depth as needed to provide the desired degree of ventilation for the particular heating application. In this example, the channels 1226 are substantially parallel to and substantially evenly spaced about the longitudinal centerline CL, and substantially perpendicular to the transverse centerline CT. However, the channels 1226 may have any orientation needed or desired for a particular application. Additionally, it is noted that the tray 1200 does not include a transverse dividing wall 1114 (FIGS. 11A-11E).

The tray 1200 may be characterized as having various heights, for example, H1 and H2, lengths, for example, L1, L2, L3, L4, L5, L6, L7, L8, L9, and L10, radii of curvature, for example, R1, R2, R3, R4, R5, R6, R7, R8, R9, and R10, and angles, for example, A1, each of which may vary for a particular application. The dimensions of each platform 1210 may be substantially identical or may differ, and varying degrees of symmetry are contemplated hereby.

If desired, a microwave energy interactive element (not shown) may overlie and may be joined to at least a portion of the tray 1200. For example, a susceptor (not shown) may overlie all or a portion of one or both platforms 1210, including all or a portion of each top face 1218, interior face 1220, exterior face 1222, and/or corner face 1224, all or a portion of recess 1212, and/or all or a portion of one or more of channels 1226.

Figure 13A:
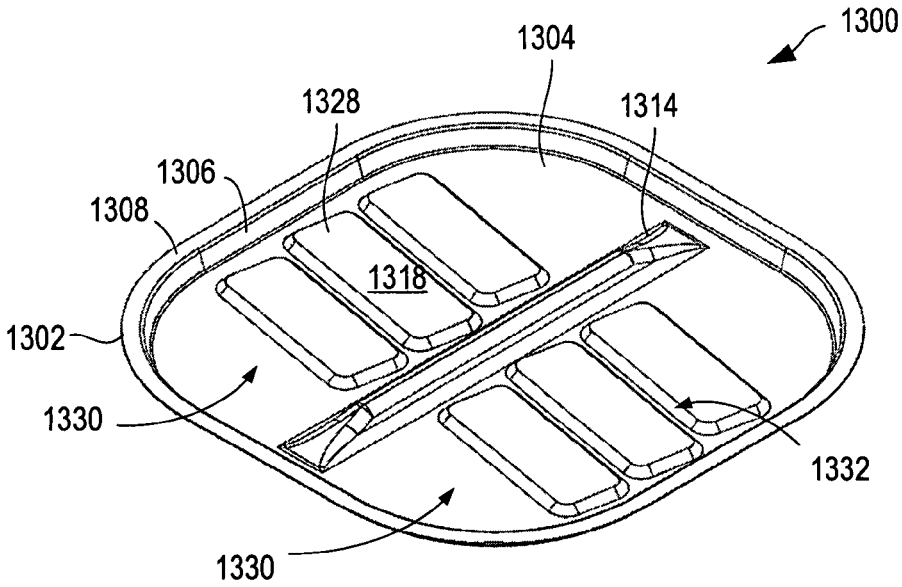
FIG. 13A is a schematic perspective view of a variation of the tray of FIGS. 11A-11E according to various aspects of the invention, including a plurality of raised portions that collectively act as a platform.
Figure 13B:
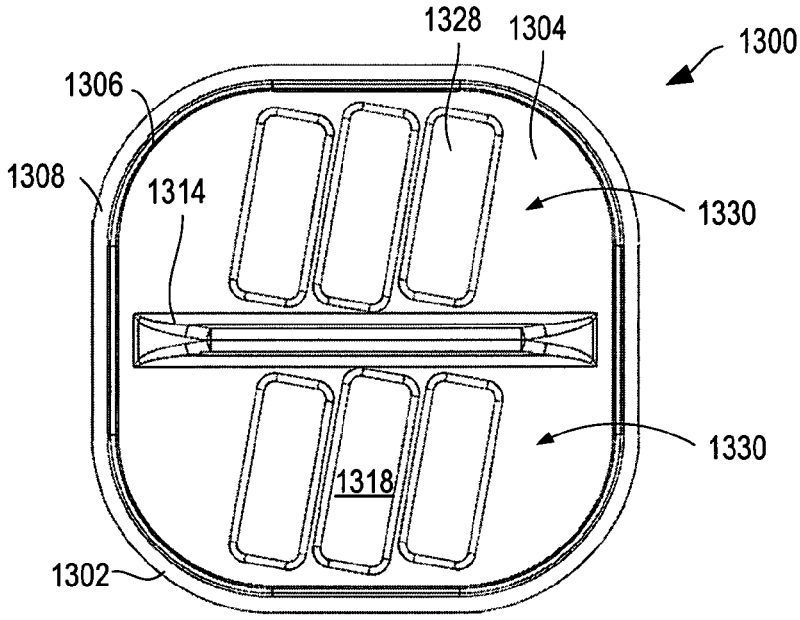
FIG. 13B is a schematic top plan view of the tray of FIG. 13A.

FIGS. 13A and 13B schematically depict still another exemplary tray 1300 according to various aspects of the invention. The tray 1300 includes some features that are similar to tray 1100 shown in FIGS. 11A-11D, except for variations noted and variations that will be understood by those of skill in the art. For simplicity, the reference numerals of similar features are preceded in the figures with a "13" instead of an "11".

In this example, platforms 1110 of FIGS. 11A-11D are replaced with a plurality of substantially rectangular raised portions 1328 arranged as a pair of opposed groups 1330 separated by transverse divider 1314. Each group includes three raised portions 1328 arranged in a substantially parallel configuration oblique to transverse wall 1314. However, other numbers, shapes, and arrangements of raised portions are contemplated. The raised portions 1328 within each group 1330 collectively serve as a platform for receiving a food item (not shown) thereon, with the spaces 1332 between adjacent raised portions 1328 providing ventilation of the food item (not shown) during the heating cycle.

If desired, a microwave energy interactive element (not shown) may overlie and may be joined to at least a portion of the tray 1300. For example, a susceptor (not shown) may overlie all or a portion of one or more raised portions 1328 to enhance the heating, browning, and/or crisping of a food item heated thereon.

Figure 14A:
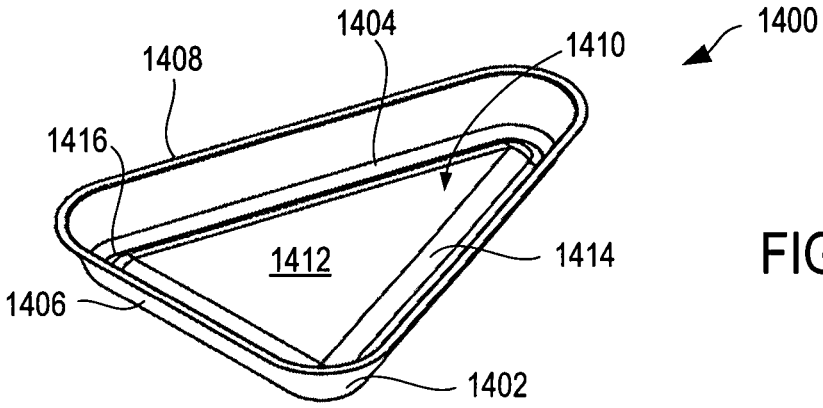
FIG. 14A is a schematic perspective view of another exemplary tray according to various aspects of the invention, having a generally triangular shape.
Figure 14B:
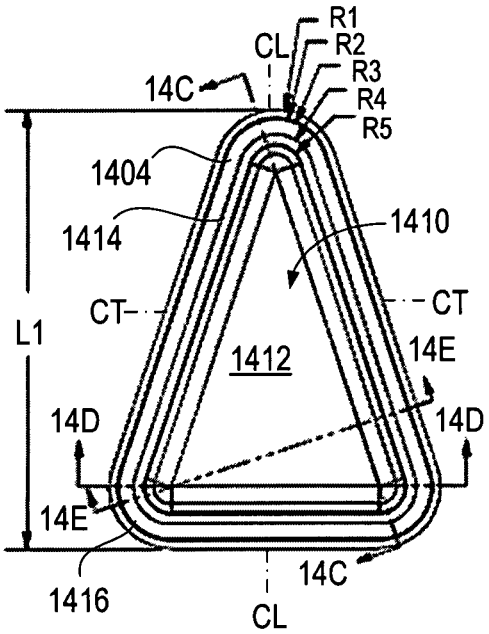
FIG. 14B is a schematic top plan view of the tray of FIG. 14A.

FIGS. 14A-14E schematically depict another exemplary tray 1400 according to various aspects of the invention. The tray 1400 is substantially triangular in shape with rounded corners 1402 and is substantially symmetrical along a longitudinal centerline CL. However, numerous other shapes and configurations are contemplated hereby. The tray 1400 also includes a transverse centerline CT, as indicated in FIG. 14B.

Figure 14C:
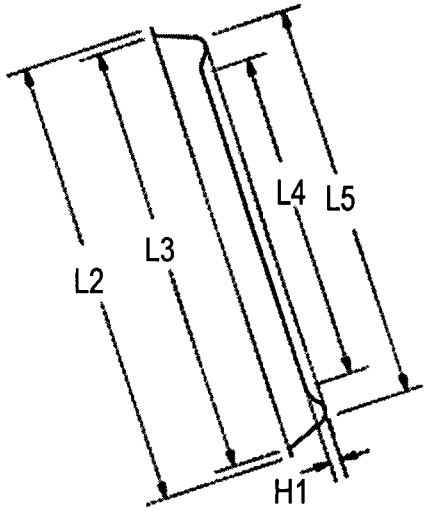
FIG. 14C is a schematic cross-sectional view of the tray of FIG. 14B taken along a line 14C-14C.
Figure 14D:
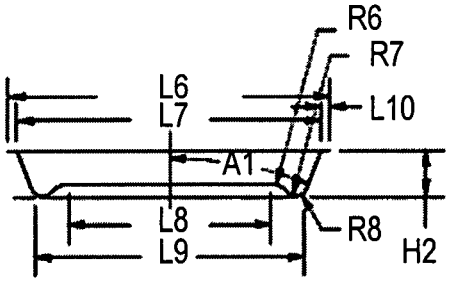
FIG. 14D is a schematic cross-sectional view of the tray of FIG. 14B taken along a line 14D-14D.
Figure 14E:
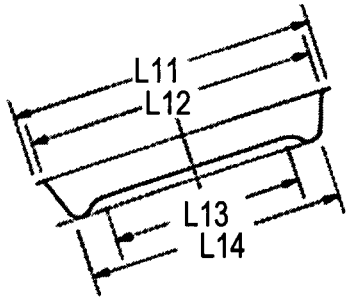
FIG. 14E is a schematic cross-sectional view of the tray of FIG. 14B taken along a line 14E-14E.
Figure 15A:
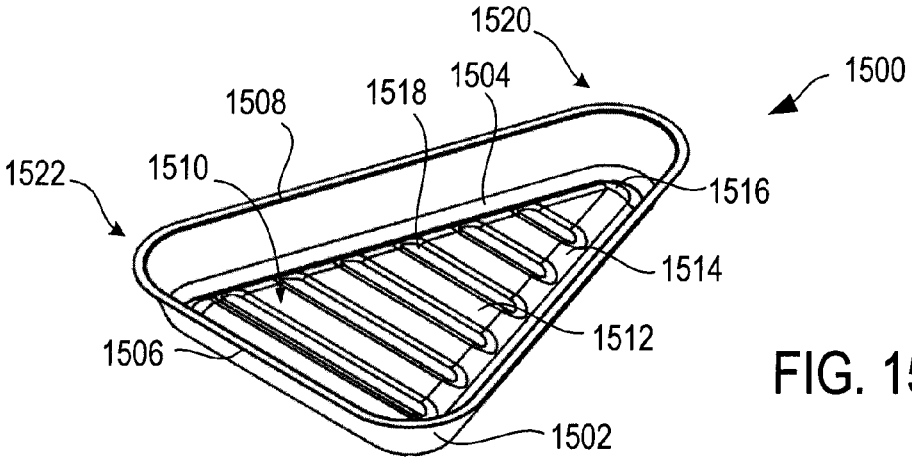
FIG. 15A is a schematic perspective view of an exemplary variation of the tray of FIGS. 14A-14D according to various aspects of the invention, including a plurality of channels.
Figure 15B:
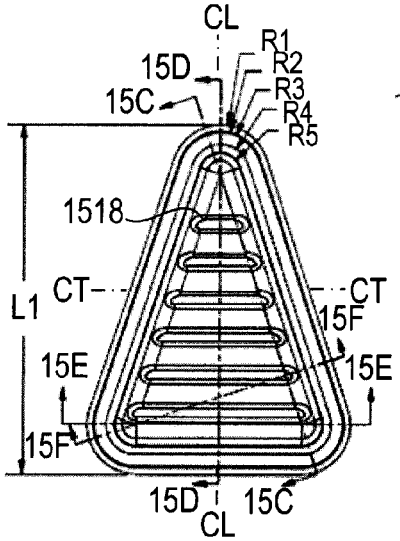
FIG. 15B is a schematic top plan view of the tray of FIG. 15A.
Figure 15C:
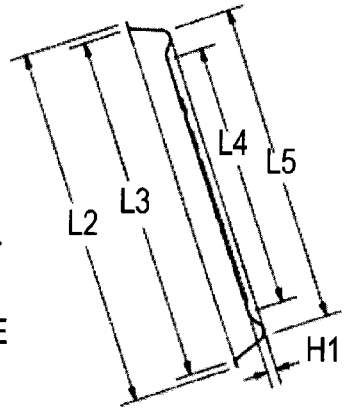
FIG. 15C is a schematic cross-sectional view of the tray of FIG. 15B taken along a line 15C-15C.
Figure 15D:
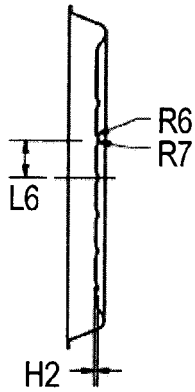
FIG. 15D is a schematic cross-sectional view of the tray of FIG. 15B taken along a line 15D-15D.
Figure 15E:
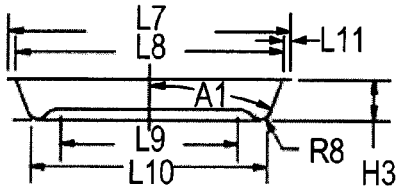
FIG. 15E is a schematic cross-sectional view of the tray of FIG. 15B taken along a line 15E-15E.
Figure 15F:
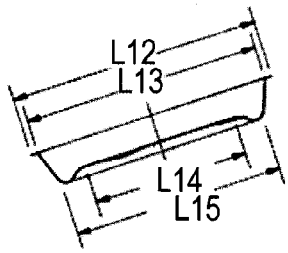
FIG. 15F is a schematic cross-sectional view of the tray of FIG. 15B taken along a line 15F-15F.
Figure 16A:
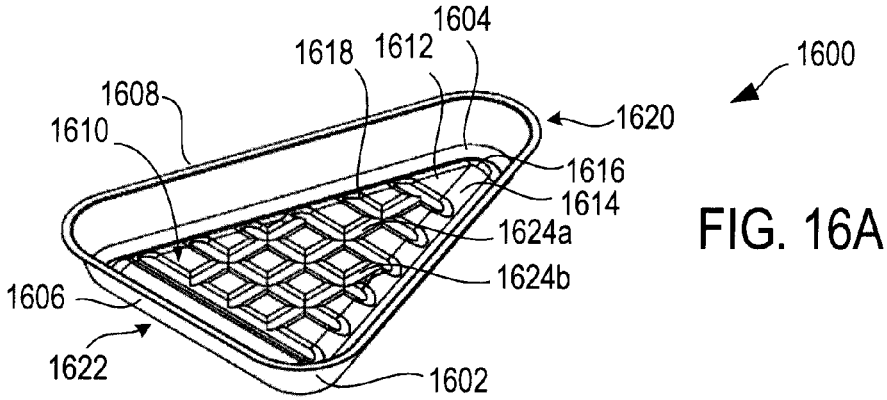
FIG. 16A is a schematic perspective view of another exemplary variation of the tray of FIGS. 14A-14D according to various aspects of the invention, including a plurality of channels.
Figure 16B:
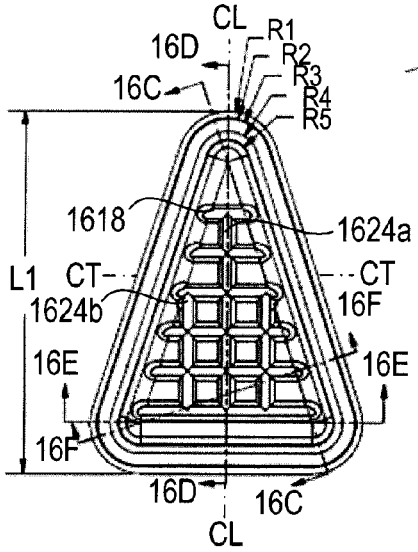
FIG. 16B is a schematic top plan view of the tray of FIG. 16A.
Figure 16C:
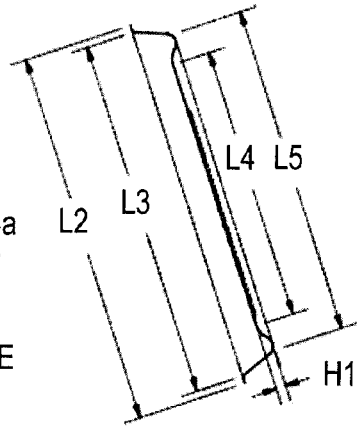
FIG. 16C is a schematic cross-sectional view of the tray of FIG. 16B taken along a line 16C-16C.
Figure 16D:
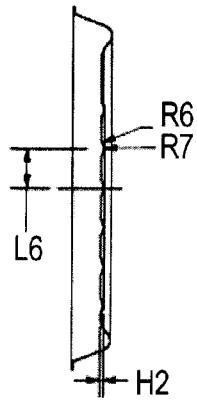
FIG. 16D is a schematic cross-sectional view of the tray of FIG. 16B taken along a line 16D-16D.
Figure 16E:
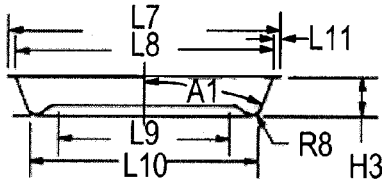
FIG. 16E is a schematic cross-sectional view of the tray of FIG. 16B taken along a line 16E-16E.
Figure 16F:
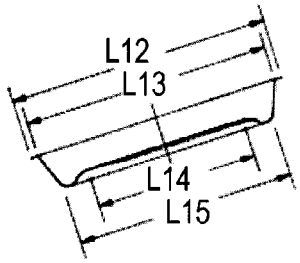
FIG. 16F is a schematic cross-sectional view of the tray of FIG. 16B taken along a line 16F-16F.
Figure 17A:
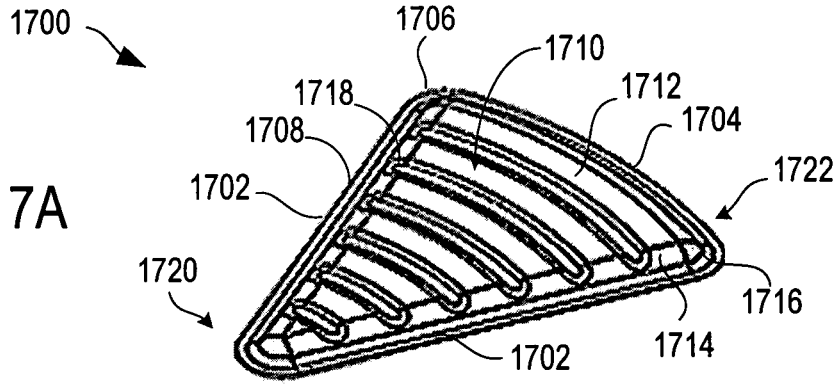
FIG. 17A is a schematic perspective view of still another exemplary tray according to various aspects of the invention, having a somewhat circular sector shape.
Figure 17B:
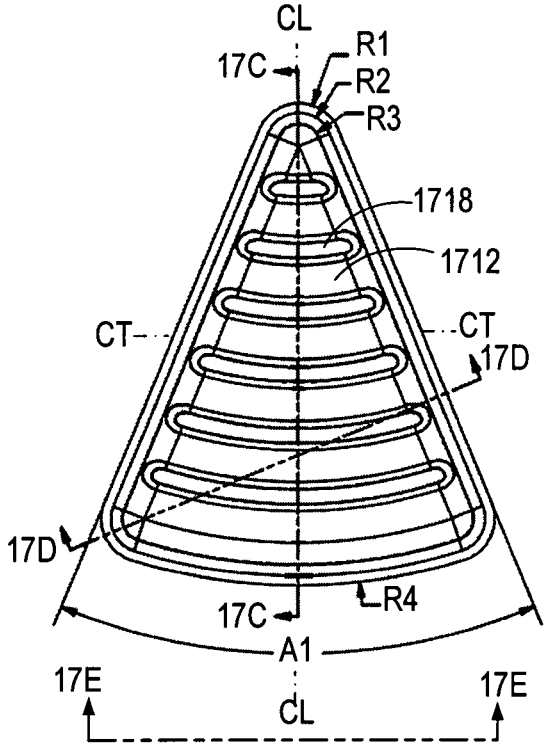
FIG. 17B is a schematic top plan view of the tray of FIG. 17A.
Figure 17C:
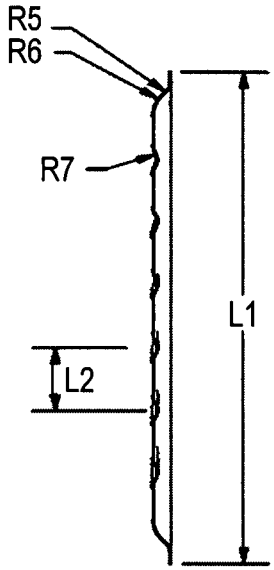
FIG. 17C is a schematic cross-sectional view of the tray of FIG. 17B taken along a line 17C-17C.
Figure 17D:
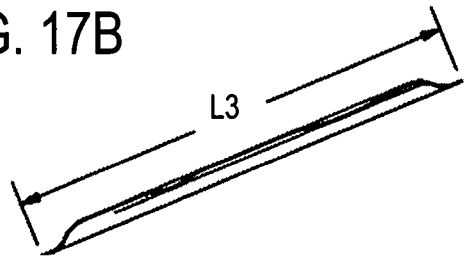
FIG. 17D is a schematic cross-sectional view of the tray of FIG. 17B taken along a line 17D-17D.
Figure 17E:
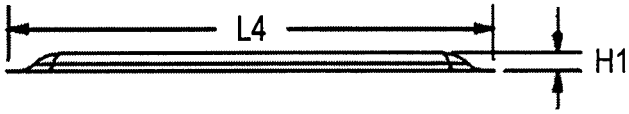
FIG. 17E is a schematic end view of the tray of FIG. 17B, viewed along a line 17E-17E.
Figure 18A:
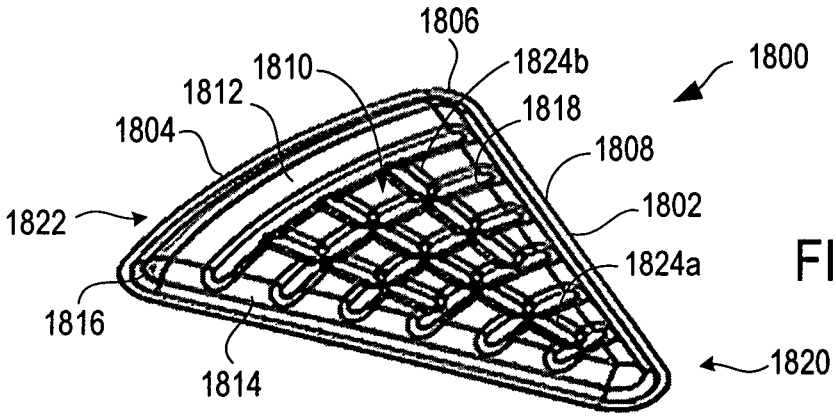
FIG. 18A is a schematic perspective view of an exemplary variation of the tray of FIGS. 17A-17E according to various aspects of the invention, including additional channels.
Figure 18B:
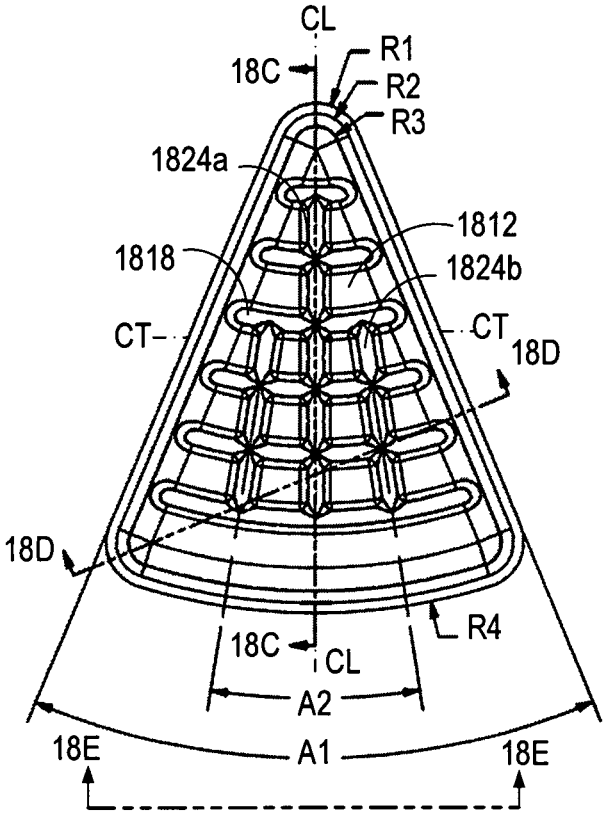
FIG. 18B is a schematic top plan view of the tray of FIG. 18A.
Figure 18C:
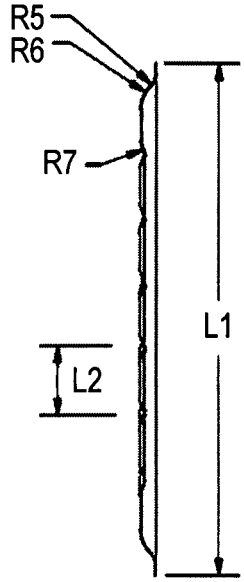
FIG. 18C is a schematic cross-sectional view of the tray of FIG. 18B taken along a line 18C-18C.
Figure 18D:
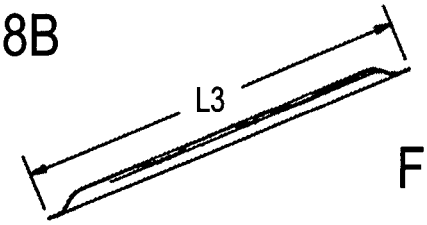
FIG. 18D is a schematic cross-sectional view of the tray of FIG. 18B taken along a line 18D-18D.
Figure 18E:
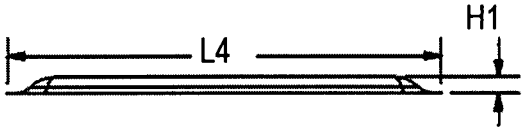
FIG. 18E is a schematic end view of the tray of FIG. 18B, viewed along a line 18E-18E.

The tray 1400 includes a rim or base 1404 and a plurality of walls 1406 extending upwardly from the base 1404. The walls 1406 optionally terminate with a flange or lip 1408. The tray 1400 further includes a substantially triangular shaped raised portion or platform 1410 including a top surface or face 1412 intended to receive a food item thereon, and a plurality of somewhat upstanding side faces 1414 joined by somewhat arcuate corner faces 1416. In this example, the top surface 1412 is substantially planar. However, it will be understood that contoured surfaces are contemplated hereby. The side faces 1414 and corner faces 1416 extend obliquely and outwardly from the top surface 1412 to the base 1404, as best seen in FIGS. 14C-14E.

It will be understood that, in this and other aspects of the invention, the various faces 1412, 1414, and 1416 are described as being individual faces or surfaces merely for purposes of simplicity and ease of description, and that such faces or surfaces may be substantially continuous and without having a defined boundary between them. Furthermore, it will be understood that the platform may have any desired shape, and that numerous other regular and irregular shapes are contemplated hereby.

The various elements and aspects of the tray 1400 may be characterized as having various heights, for example, H1 and H2, lengths, for example, L1, L2, L3, L4, L5, L6, L7, L8, L9, L10, L11, L12, L13, and L14, radii of curvature, for example, R1, R2, R3, R4, R5, R6, R7, and R8, and angles, for example, A1, each of which may vary for a particular application.

If desired, a microwave energy interactive element (not shown) may overlie and may be joined to at least a portion of the tray 1400. For example, a susceptor (not shown) may overlie all or a portion of the platform 1410, including all or a portion of top face 1412, side faces 1414, and/or corner faces 1416. Additionally, as with the various other examples of constructs provided herein or contemplated hereby, the tray may include one or more physical apertures (not shown) to allow for venting through the sidewalls and/or bottom of the tray. The tray 1400 may be used as described above in connection with the various other exemplary trays.

FIGS. 15A-15F schematically illustrate still another exemplary tray 1500 according to various aspects of the invention. The tray 1500 includes features that are similar to tray 1400 shown in FIGS. 14A-14E, except for variations noted and variations that will be understood by those of skill in the art. For simplicity, the reference numerals of similar features are preceded in the figures with a "15" instead of a "14".

In this example, the tray 1500 includes a plurality of channels 1518 in the platform 1510 extending in a direction that is substantially parallel to transverse centerline CT and substantially perpendicular to longitudinal centerline CL. Other configurations are contemplated. In this example, the tray 1500 includes six channels 1518 of varying length, with shorter channels 1518 proximate a first, narrower end 1520 of the tray 1500, and longer channels 1518 proximate a second, wider end 1522 of the tray 1500. The channels 1518 may have any suitable depth as needed to provide the desired degree of ventilation for the particular heating application.

The tray 1500 may be characterized as having various heights, for example, H1, H2, and H3, lengths, for example, L1, L2, L3, L4, L5, L6, L7, L8, L9, L10, L11, L12, L13, L14, and L15, radii of curvature, for example, R1, R2, R3, R4, R5, R6, R7, and R8, and angles, for example, A1, each of which may vary for a particular application.

If desired, a microwave energy interactive element (not shown) may overlie and may be joined to at least a portion of the tray 1500. For example, a susceptor (not shown) may overlie all or a portion of the platform 1510, including all or a portion of top face 1512, side faces 1514, and/or corner faces 1516, and/or all or a portion of one or more of channels 1518. The tray 1500 may be used as described above.

FIGS. 16A-16F schematically depict still another exemplary tray 1600 according to various aspects of the invention. The tray 1600 includes features that are similar to tray 1400 shown in FIGS. 14A-14E and tray 1500 shown in FIGS. 15A-15F, except for variations noted and variations that will be understood by those of skill in the art. For simplicity, the reference numerals of similar features are preceded in the figures with a "16" instead of a "14" or "15", respectively.

In this example, the tray 1600 includes a plurality of channels 1618 in the platform 1610 extending in a transverse direction substantially parallel to transverse centerline CT and substantially perpendicular to longitudinal centerline CL, and a plurality of grooves or channels 1624 extending in a longitudinal direction substantially parallel to longitudinal centerline CL and substantially perpendicular to transverse centerline CT. Such additional channels may be desirable where additional venting is needed.

In this example, the tray 1600 includes six transverse channels 1618 of varying length, with shorter channels 1618 proximate a first, narrower end 1620 of the tray 1600, and longer channels 1618 proximate a second, wider end 1622 of the tray 1600. The tray 1600 also includes three longitudinal channels 1624*a*, 1624*b* of varying length, with the longest channel 1624*a* proximate the longitudinal centerline CL and the shorter channels 1624*b* proximate walls 1606. However, other configurations may be used if desired. The channels 1618, 1624*a*, 1624*b* may have any suitable depth as needed to provide the desired degree of ventilation for the particular heating application.

The tray 1600 may be characterized as having various heights, for example, H1, H2, and H3, lengths, for example, L1, L2, L3, L4, L5, L6, L7, L8, L9, L10, L11, L12, L13, L14, and L15, radii of curvature, for example, R1, R2, R3, R4, R5, R6, R7, and R8, and angles, for example, A1, each of which may vary for a particular application.

If desired, a microwave energy interactive element (not shown) may overlie and may be joined to at least a portion of the tray 1600. For example, a susceptor (not shown) may overlie all or a portion of the platform 1610, including all or a portion of top face 1612, side faces 1614, and/or corner faces 1616, and/or all or a portion of one or more of channels 1618, 1624*a*, and/or 1624*b*. The tray 1600 may be used substantially as described above.

FIGS. 17A-17E schematically illustrate still another exemplary tray 1700 according to various aspects of the invention. The tray 1700 generally has the shape of a sector of a circle, with a pair of radial sides 1702, an arcuate side 1704, and rounded corners 1706 joining the radial sides 1702 and arcuate side 1704. The tray 1700 is substantially symmetrical along a longitudinal centerline CL. The tray 1700 also includes a transverse centerline CL.

The tray 1700 includes a peripheral rim 1708 and a platform 1710 extending upwardly from the rim 1708. The platform 1710 includes a substantially planar top surface or face 1712 for receiving a food item (not shown) and a plurality of adjoined side faces 1714 and corner faces 1716 that extend obliquely and outwardly between the top face 1712 to the rim 1708. The platform 1710 includes a plurality of channels 1718 extending in a generally transverse direction. In this example, the platform 1710 includes six channels of varying length, with shorter channels 1718 proximate a first, narrower end 1720 of the tray 1700, and longer channels proximate a second, wider end 1722 of the tray 1700 (i.e., proximate the arcuate side 1704 of the tray 1700). The channels 1718 may have any suitable depth as needed to provide the desired degree of ventilation for the particular heating application. Each channel 1718 may have a radius of curvature similar to that of the arcuate side 1704, in this example, R4. However, numerous other configurations are contemplated hereby.

The tray 1700 may be characterized as having various heights, for example, H1, lengths, for example, L1, L2, L3, and L4, radii of curvature, for example, R1, R2, R3, R4, R5, R6, and R7, and angles, for example, A1, each of which may vary for a particular application.

If desired, a microwave energy interactive element (not shown) may overlie and may be joined to at least a portion of the tray 1700. For example, a susceptor (not shown) may overlie all or a portion of the platform 1710, including all or a portion of top face 1712, side faces 1714, and/or corner faces 1716, and/or all or a portion of one or more of channels 1718.

FIGS. 18A-18E schematically illustrate still another exemplary tray 1800 according to various aspects of the invention. The tray 1800 includes features that are similar to tray 1700 shown in FIGS. 17A-17E, except for variations noted and variations that will be understood by those of skill in the art. For simplicity, the reference numerals of similar features are preceded in the figures with an "18" instead of a "17".

In this example, in addition to channels 1818 extending in a generally transverse direction, the platform 1810 includes a plurality of channels 1824*a*, 1824*b* extending in a generally longitudinal direction. In this example, the tray 1800 includes three generally longitudinal channels 1824*a*, 1824*b* of varying length, with the longest channel 1824*a* proximate to the longitudinal centerline CL and the shorter channels 1824*b* proximate radial sides 1802. Channels 1824*b* are aligned obliquely with respect to channel 1824*a* and longitudinal centerline CL, such that each channel 1824*b* is substantially equidistant from faces 1814 and channel 1824*a*, which is substantially aligned with the longitudinal centerline CL. However, numerous other arrangements are contemplated by the invention. The various channels 1818, 1824*a*, 1824*b* may have any suitable depth as needed to provide the desired degree of ventilation for the particular heating application.

The tray 1800 may be characterized as having various heights, for example, H1, lengths, for example, L1, L2, L3, and L4, radii of curvature, for example, R1, R2, R3, R4, R5, R6, and R7, and angles, for example, A1 and A2, each of which may vary for a particular application.

If desired, a microwave energy interactive element (not shown) may overlie and may be joined to at least a portion of the tray 1800. For example, a susceptor (not shown) may overlie all or a portion of the platform 1810, including all or a portion of top face 1812, side faces 1814, and/or corner faces 1816, and/or all or a portion of one or more of channels 1818, 1824*a*, and/or 1824*b*.

FIGS. 19A-19E schematically illustrate still another exemplary tray 1900 according to various aspects of the invention. The tray 1900 includes features that are similar to tray 1700 shown in FIGS. 17A-17E, except for variations noted and variations that will be understood by those of skill in the art. For simplicity, the reference numerals of similar features are preceded in the figures with a "19" instead of a "17".

In this example, the tray 1900 includes a plurality of adjoined side walls 1926 and corner walls 1928 extending upwardly from the rim 1908. Such a tray might be suitable, for example, where the food item heated in the tray includes components that may fall from the food item, or where it is desired that the tray be used as a container for transporting the food item before or during consumption. As with the numerous other examples herein, the walls may include one or more apertures extending therethrough to provide additional ventilation during the heating cycle.

If desired, a microwave energy interactive element (not shown) may overlie and may be joined to at least a portion of the tray 1900. For example, a susceptor (not shown) may overlie all or a portion of the platform 1910, including all or a portion of top face 1912, side faces 1914, and/or corner faces 1916, and/or all or a portion of one or more of channels 1918. The tray 1900 may be characterized as having various heights, for example, H1 and H2, lengths, for example, L1, L2, L3, L4, L5, L6, L7, L8, L9, L10, L11, L12, L13, and L14, radii of curvature, for example, R1, R2, R3, R4, R5, R6, R7, R8, R9, and R10, and angles, for example, A1, each of which may vary for a particular application.

Numerous materials may be suitable for use in forming the various constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, all or a portion of each tray may be formed at least partially from a paperboard material, which may be cut into a blank prior to use in the tray. For example, a tray may be formed at least partially from paperboard having a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International. Alternatively, all or a portion of the tray may be formed at least partially from a polymer or polymeric material, for example, coextruded polyethylene terephthalate or polypropylene. Other materials are contemplated hereby.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively still, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive structure, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5221,419; 5,213,902; 5,117,078; 5,039,364;

4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

It will be understood that while susceptor elements are discussed in detail herein, numerous other microwave energy interactive elements and combinations thereof are contemplated hereby. For example, the microwave interactive element may comprise a foil (not shown) having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with other elements, for example, susceptors.

It will be understood that with some combinations of elements and materials, the microwave interactive material or element may have a grey or silver color this is visually distinguishable from the substrate or the other components in the structure. However, in some instances, it may be desirable to provide a structure having a uniform color and/or appearance. Such a structure may be more aesthetically pleasing to a consumer, particularly when the consumer is accustomed to packages, containers, trays, or other constructs having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the structure with a silver or grey ink or other concealing color in a suitable pattern or as a solid color layer to mask or conceal the presence of the microwave interactive element, or any other suitable technique or combination thereof.

The present invention may be understood further by way of the following examples, which are not to be construed as limiting in any manner.

EXAMPLE 1

A construct according to FIGS. 1A-1D was formed with the following approximate dimensions: H1 was about 0.19 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., R1 was about 0.25 in., R2 was about 0.25 in., and R3 was about 0.25 in. However, other suitable dimensions are contemplated hereby. A 48 gauge metallized polyethylene terephthalate film (i.e., a susceptor film) was joined to the construct, substantially as illustrated in FIG. 1E.

EXAMPLE 2

A construct according to FIGS. 1A-1D was formed with the following approximate dimensions: H1 was about 0.19 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., R1 was about 0.25 in., R2 was about 0.25 in., and R3 was about 0.25 in. However, other suitable dimensions are contemplated hereby. A 48 gauge metallized polyethylene terephthalate film (i.e., a susceptor film) was joined to the construct, substantially as illustrated in FIG. 2.

EXAMPLE 3

A construct according to FIGS. 1A-1D was formed with the following approximate dimensions: H1 was about 0.19 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., R1 was about 0.25 in., R2 was about 0.25 in., and R3 was about 0.25 in. However, other suitable dimensions are contemplated hereby. A 48 gauge metallized polyethylene terephthalate film (i.e., a susceptor film) was joined to the construct, substantially as illustrated in FIG. 3.

EXAMPLE 4

A construct according to FIGS. 1A-1D was formed with the following approximate dimensions: H1 was about 0.19 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., R1 was about 0.25 in., R2 was about 0.25 in., and R3 was about 0.25 in. However, other suitable dimensions are contemplated hereby. A 48 gauge metallized polyethylene terephthalate film (i.e., a susceptor film) was joined to the construct, substantially as illustrated in FIG. 4.

EXAMPLE 5

A construct according to FIGS. 1A-1D was formed with the following approximate dimensions: H1 was about 0.19 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., R1 was about 0.25 in., R2 was about 0.25 in., and R3 was about 0.25 in. However, other suitable dimensions are contemplated hereby. A 48 gauge metallized polyethylene terephthalate film (i.e., a susceptor film) was joined to the construct, as substantially as illustrated in FIG. 5.

EXAMPLE 6

A construct according to FIGS. 6A-6D was formed with the following approximate dimensions: H1 was about 0.19 in., H2 was about 0.060 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 1.0 in., L9 was about 0.42 in., R1 was about 0.25 in., R2 was about 0.25 in., R3 was about 0.25 in., and R4 was about 0.25 in. However, other suitable dimensions are contemplated hereby. A 48 gauge metallized polyethylene terephthalate film (i.e., a susceptor film) was joined to the construct overlying various components, including at least a portion of the top faces 608 of the platforms 604.

EXAMPLE 7

A construct according to FIGS. 7A-7D was formed with the following approximate dimensions: H1 was about 0.19 in., H2 was about 0.37 in., L1 was about 7.8 in., L2 was about 5.2 in., L3 was about 1.9 in., L4 was about 2.2 in., L5 was about 0.94 in., L6 was about 1.9 in., L7 was about 6.2 in., L8 was about 6.4 in., L9 was about 6.9 in., L10 was about 1.0 in., L11 was about 0.19 in., R1 was about 0.25 in., R2 was about 0.25 in., R3 was about 0.25 in., R4 was about 0.25 in., R5 was about 0.25 in., R6 was about 2.3 in., R7 was about 1.8 in., and A1 was about 18°. However, other suitable dimensions are contemplated hereby. A 48 gauge metallized polyethylene terephthalate film (i.e., a susceptor film) was joined to the construct overlying various components, including at least a portion of the top faces 708 of the platforms 704.

EXAMPLE 8

A construct according to FIGS. 8A-8D was formed with the following approximate dimensions: H1 was about 0.19 in., H2 was about 0.060 in., L1 was about 6.0 in., L2 was about 5.5 in., L3 was about 0.28 in., L4 was about 0.94 in., L5 was about 1.9 in., L6 was about 6.2 in., L7 was about 5.4 in., L8 was about 0.42 in., L9 was about 1.5 in., L10 was about 1.0 in., R1 was about 0.25 in., R2 was about 0.25 in., R3 was about 0.25 in., and R4 was about 0.25 in. However, other suitable dimensions are contemplated hereby. A 48 gauge metallized polyethylene terephthalate film (i.e., a susceptor film) was joined to the construct overlying various components, including at least a portion of the top faces 808 of the platforms 804.

EXAMPLE 9

A construct according to FIGS. 9A-9E may have the following approximate dimensions: H1 may be about 0.19 in., H2 may be about 0.040 in., L1 may be about 6.0 in., L2 may be about 5.5 in., L3 may be about 0.28 in., L4 may be about 0.94 in., L5 may be about 6.2 in., L6 may be about 5.4 in., L7 may be about 0.42 in., L8 may be about 0.75 in., R1 may be about 0.25 in., R2 may be about 0.25 in., R3 may be about 0.25 in., and R4 may be about 0.25 in. However, other suitable dimensions are contemplated hereby. A susceptor film or other microwave energy interactive element may overlie at least a portion of the construct.

EXAMPLE 10

A construct according to FIGS. 10A-10D was formed with the following approximate dimensions: H1 was about 0.27 in., H2 was about 0.060 in., L1 was about 6.0 in., L2 was about 5.7 in., L3 was about 0.17 in., L4 was about 1.1 in., L5 was about 1.9 in., L6 was about 6.2 in., L7 was about 5.5 in., L8 was about 0.36 in., L9 was about 1.5 in., L10 was about 1.0 in., R1 was about 0.25 in., R2 was about 0.25 in., R3 was about 0.25 in., and R4 was about 0.25 in. However, other suitable dimensions are contemplated hereby. A 48 gauge metallized polyethylene terephthalate film (i.e., a susceptor film) was joined to the construct overlying various components, including at least a portion of the top faces 1008 of the platforms 1004.

EXAMPLE 11

A construct according to FIGS. 11A-11E was formed with the following approximate dimensions: H1 was about 0.19 in., H2 was about 0.19 in., H3 was about 0.25 in., H4 was about 0.37 in., L1 was about 7.6 in., L2 was about 5.4 in., L3 was about 2.0 in., L4 was about 2.2 in., L5 was about 6.6 in., L6 was about 6.2 in., L7 was about 5.5 in., L8 was about 6.0 in., L9 was about 0.19 in., R1 was about 2.2 in., R2 was about 1.7 in., R3 was about 0.50 in., R4 was about 0.16 in., R5 was about 0.080 in., R6 was about 0.25 in., R7 was about 0.19 in., R8 was about 0.020 in., R9 was about 0.25 in., A1 was about 18°, A2 was about 30°, and A3 was about 15°. However, other suitable dimensions are contemplated hereby. A 48 gauge metallized polyethylene terephthalate film (i.e., a susceptor film) was joined to the construct overlying various components, including at least a portion of the top faces 1118 of the platforms 1110.

EXAMPLE 12

A construct according to FIGS. 12A-12D was formed with the following approximate dimensions: H1 was about 0.19 in., H2 was about 0.37 in., L1 was about 7.8 in., L2 was about 5.5 in., L3 was about 2.0 in., L4 was about 2.2 in., L5 was about 1.1 in., L6 was about 6.9 in. (square), L7 was about 6.4 in. (square), L8 was about 1.0 in., L9 was about 6.2 in. (square), L10 was about 0.19 in., R1 was about 2.3 in., R2 was about 1.8 in., R3 was about 0.50 in., R4 was about 0.25 in., R5 was about 0.25 in., R6 was about 0.19 in., R7 was about 0.19 in., R8 was about 0.25 in., R9 was about 0.25 in., R10 was about 0.19 in., and A1 was about 18°. However, other suitable dimensions are contemplated hereby. A 48 gauge metallized polyethylene terephthalate film (i.e., a susceptor film) was joined to the construct overlying various components, including at least a portion of the top faces 1218 of the platforms 1210.

EXAMPLE 13

A construct according to FIGS. 14A-14E may be formed with the following approximate dimensions: H1 may be about 0.25 in., H2 may be about 1 in., L1 may be about 9.2 in., L2 may be about 9.6 in., L3 may be about 9.2 in., L4 may be about 7.0 in., L5 may be about 8.5 in., L6 may be about 7.0 in., L7 may be about 6.6 in., L8 may be about 4.4 in., L9 may be about 5.9 in., L10 may be about 0.19 in., L11 may be about 6.7 in., L12 may be about 6.4 in., L13 may be about 4.2 in., L14 may be about 5.6 in., R1 may be about 1.3 in., R2 may be about 1.1 in., R3 may be about 1.1 in., R4 may be about 0.78 in., R5 may be about 0.56 in., R6 may be about 0.48 in., R7 may be about 0.25 in., R8 may be about 0.25 in., and A1 may be about 21°. Other suitable dimensions are contemplated hereby. A susceptor film or other microwave energy interactive element may overlie at least a portion of the construct.

EXAMPLE 14

A construct according to FIGS. 15A-15F may be formed with the following approximate dimensions: H1 may be about 0.25 in., H2 may be about 0.063 in., H3 may be about 1.0 in., L1 may be about 9.2 in., L2 may be about 9.6 in., L3 may be about 9.2 in., L4 may be about 7.0 in., L5 may be about 8.5 in., L6 may be about 1.0 in., L7 may be about 7.0 in., L8 may be about 6.6 in., L9 may be about 4.4 in., L10 may be about 5.9 in., L11 may be about 0.2 in., L12 may be about 6.7 in., L13 may be about 6.4 in., L14 may be about 4.2 in., L15 may be about 5.6 in., R1 may be about 1.3 in., R2 may be about 1.1 in., R3 may be about 1.1 in., R4 may be about 0.78 in., R5 may be about 0.56 in., R6 may be about 0.25 in., R7 may be about 0.25 in., R8 may be about 0.25 in., and A1 may be about 21°. Other suitable dimensions are contemplated hereby. A susceptor film or other microwave energy interactive element may overlie at least a portion of the construct.

EXAMPLE 15

A construct according to FIGS. 16A-16F may be formed with the following approximate dimensions: H1 may be about 0.25 in., H2 may be about 0.063 in., H3 may be about 1.0 in., L1 may be about 9.2 in., L2 may be about 9.6 in., L3 may be about 9.2 in., L4 may be about 7.0 in., L5 may be about 8.5 in., L6 may be about 1.0 in., L7 may be about 7.0 in., L8 may be about 6.6 in., L9 may be about 4.4 in., L10 may be about 5.9 in., L11 may be about 0.2 in., L12 may be about 6.7 in., L13 may be about 6.4 in., L14 may be about 4.2 in., L15 may be about 5.6 in., R1 may be about 1.3 in., R2 may be about 1.1 in., R3 may be about 1.1 in., R4 may be about 0.78 in., R5 may be about 0.56 in., R6 may be about 0.25 in., R7 may be about 0.25 in., R8 may be about 0.25 in., and A1 may be about 21°. Other suitable dimensions are contemplated hereby. A susceptor film or other microwave energy interactive element may overlie at least a portion of the construct.

EXAMPLE 16

A construct according to FIGS. 17A-17E may be formed with the following approximate dimensions: H1 may be about 0.25 in., L1 may be about 7.9 in., L2 may be about 1.0 in., L3 may be about 6.0 in., L4 may be about 6.4 in., R1 may be about 0.70 in., R2 may be about 0.54 in., R3 may be about 0.36 in., R4 may be about 9.0 in., R5 may be about 0.25 in., R6 may be about 0.50 in., R7 may be about 0.25 in., and A1 may be about 45°. Other suitable dimensions are contemplated hereby. A susceptor film or other microwave energy interactive element may overlie at least a portion of the construct.

EXAMPLE 17

A construct according to FIGS. 18A-18E may be formed with the following approximate dimensions: H1 may be about 0.25 in., L1 may be about 7.9 in., L2 may be about 1.0 in., L3 may be about 6.0 in., L4 may be about 6.4 in., R1 may be about 0.70 in., R2 may be about 0.54 in., R3 may be about 0.36 in., R4 may be about 9.0 in., R5 may be about 0.25 in., R6 may be about 0.50 in., R7 may be about 0.25 in., A1 may be about 45°, and A2 may be about 18°. Other suitable dimensions are contemplated hereby. A susceptor film or other microwave energy interactive element may overlie at least a portion of the construct.

EXAMPLE 18

A construct according to FIGS. 19A-19E may be formed with the following approximate dimensions: H1 may be about 1.0 in., H2 may be about 0.25 in., L1 may be about 10 in., L2 may be about 8.6 in., L3 may be about 7.5 in., L4 may be about 1.0 in., L5 may be about 0.12 in., L6 may be about 7.9 in., L7 may be about 7.5 in., L8 may be about 5.3 in., L9 may be about 6.7 in., L10 may be about 8.3 in., L11 may be about 7.9 in., L12 may be about 5.7 in., L13 may be about 7.2 in., R1 may be about 1.3 in., R2 may be about 1.1 in., R3 may be about 1.1 in., R4 may be about 0.78 in., R5 may be about 0.56 in., R6 may be about 0.25 in., R7 may be about 0.25 in., R8 may be about 0.50 in., R9 may be about 0.25 in., R10 may be about 0.25 in., and A1 may be about 20°. Other suitable dimensions are contemplated hereby. A susceptor film or other microwave energy interactive element may overlie at least a portion of the construct.

EXAMPLES 19-30

Commercially available frozen Lean Cuisine and Corner Bistro panini type sandwiches were evaluated using various trays and microwave ovens. Each sandwich was heated at full power for about 3 minutes and 20 seconds unless indicated otherwise. The results of the evaluations are presented in Table 1, where:

Control disk=a corrugated board with a susceptor overlying one surface and six elongated apertures with rounded, enlarged ends extending through the thickness of the disk (provided with the food items);

LC=Lean Cuisine;

CB=Corner Bistro;

A=1000 W Amana, 0.9 cu. ft., 12.5 in. turnable diameter;

B=1100 W Panasonic, 1.0 cu. ft., 13.5 in. turntable diameter;

C=1200 W Panasonic, 0.9 cu. ft., 13.5 in. turnable diameter;

D=1000 W Amana Radarange, 1.1 cu. ft., no turntable;

E=800 W Panasonic, 0.7 cu. ft., 9.5 in. turntable diameter;

F=700 W Samsung, 0.7 cu. ft. 11 in. turntable diameter; and

G=1100 W Panasonic, 1.1 cu. ft., 14 in. turntable diameter (cook time increased to 4 min);

and where:

0=no browning and/or crisping;

7=optimal browning and/or crisping; and 1, 2, 3, 4, 5, and 6=various intermediate degrees of browning and/or crisping between 0 and 7.

TABLE 1

| Example | Food item | Microwave oven | Control disk | Tray with tapered platforms (FIG. 2, Example 2) | Tray with tapered platforms (FIG. 3, Example 3) | Tray with tapered platforms (FIG. 4, Example 4) | Tray with tapered platforms and slot apertures (FIG. 5, Example 5) | Tray with tapered platforms and venting channels (FIGS. 8A-8D, Example 8) | Tray with tapered platforms and venting channels (FIGS. 10A-10D, Example 10) |
|---|---|---|---|---|---|---|---|---|---|
| 19 | LC | A | 0 | 2 | — | — | 4 | 6 | 7 |
| 20 | LC | B | 0 | 5 | — | — | 5 | 6 | 6 |
| 21 | LC | C | 0 | 5 | — | — | 0 | 6 | 5 |
| 22 | LC | D | 0 | 5 | — | — | 2 | 7 | 6 |

TABLE 1-continued

| Example | Food item | Microwave oven | Control disk | Tray with tapered platforms (FIG. 2, Example 2) | Tray with tapered platforms (FIG. 3, Example 3) | Tray with tapered platforms (FIG. 4, Example 4) | Tray with tapered platforms and slot apertures (FIG. 5, Example 5) | Tray with tapered platforms and venting channels (FIGS. 8A-8D, Example 8) | Tray with tapered platforms and venting channels (FIGS. 10A-10D, Example 10) |
|---|---|---|---|---|---|---|---|---|---|
| 23 | LC | E | 0 | 1 | — | — | 0 | 7 | 6 |
| 24 | LC | F | 0 | 3 | — | — | 1 | 2 | 2 |
| 25 | LC | G | 0 | 0 | — | — | 2 | 3 | 0 |
| 26 | CB | A | 0 | — | 4 | 3 | — | 5 | 7 |
| 27 | CB | B | 2 | — | 5 | 7 | — | 7 | 6 |
| 28 | CB | C | 3 | — | 4 | 6 | — | 5 | 6 |
| 29 | LC | A | 0 | — | 4 | 1 | — | 5 | 6 |
| 30 | LC | B | 1 | — | 7 | 7 | — | 5 | 6 |
| AVG | — | — | 0.5 | 3 | 4.8 | 4.8 | 2 | 5.3 | 3.6 |

EXAMPLE 31

Commercially available frozen Stouffer's Corner Bistro grilled chicken Italian panini sandwiches were heated using various trays to compare the level of browning achieved on the surface of the food item.

A first sandwich was placed in an open face configuration on the susceptor disk provided with the sandwich (referred to as "Control disk" in Examples 19-30). The sandwich was heated according to package directions for 3 minuted in an 1100 W Panasonic microwave oven.

A second sandwich was heated for 3 minutes in the same 1100 W Panasonic microwave oven using a tray according to the invention, substantially as shown in FIGS. 8A-8D, having the dimensions provided in Example 8.

Figure 20:
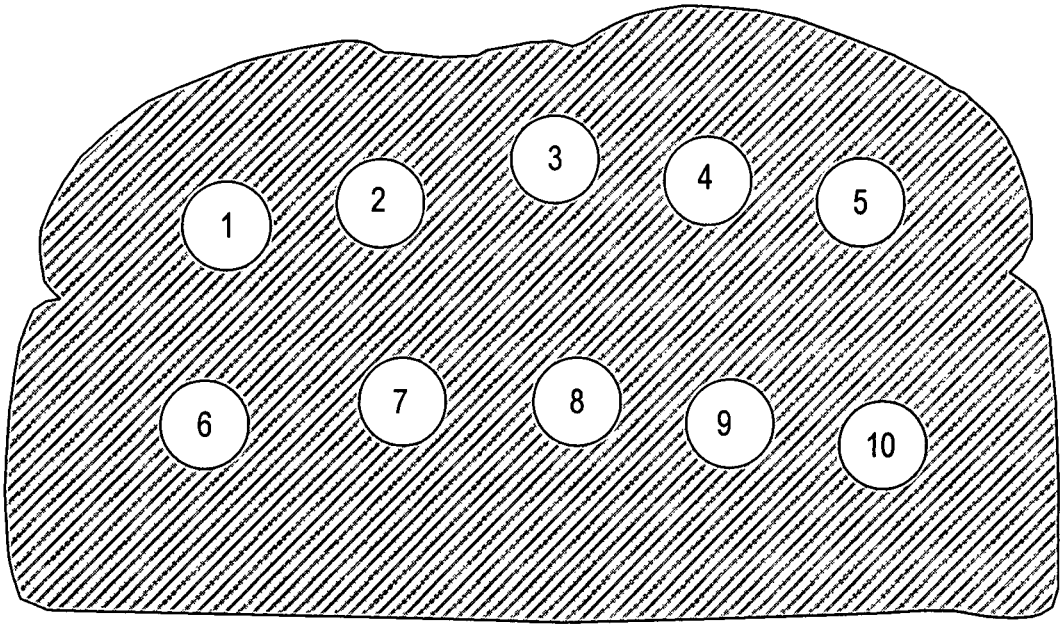
FIG. 20 schematically illustrates various points on a slice of bread where the degree of browning was measured for bread pieces heated using a commercially available susceptor disk and for bread pieces heated using a tray according to the invention.

A Konica Minolta BC-10 baking meter having an aperture size of about 7/16 in. (0.4375 in.) was used to measure the level of browning on the surface of each piece of bread at designated locations, as indicated schematically in FIG. 20. The measurements taken at each position were averaged for the two pieces of bread in each sandwich. The results are presented in baking contrast units ("BCU"), where the lower the BCU, the darker the color (i.e., the greater degree of browning). The results of the evaluation are presented in Table 2.

TABLE 2

| Position | Control disk | Experimental disk |
|---|---|---|
| 1 | 3.85 | 2.85 |
| 2 | 3.88 | 2.67 |
| 3 | 3.40 | 1.95 |
| 4 | 3.67 | 2.77 |
| 5 | 3.92 | 3.33 |
| 6 | 3.90 | 2.88 |
| 7 | 4.02 | 3.39 |
| 8 | 4.10 | 3.24 |
| 9 | 4.09 | 3.55 |
| 10 | 4.03 | 2.14 |
| Average BCU | 3.90 | 2.96 |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A tray for heating, browning, and/or crisping a food item in a microwave oven, the tray including a first centerline extending in a first direction and a second centerline extending in a second direction, wherein the first centerline is substantially perpendicular to the second centerline, the tray comprising:

a substantially planar base extending along a peripheral margin of the tray;

a pair of opposed platforms extending upwardly from the base, the pair of opposed platforms being separated by a recess extending in the second direction, wherein the opposed platforms each include an uppermost surface for receiving a food item thereon, each uppermost surface having a height relative to the base, wherein the height of each uppermost surface decreases in the second direction from the first centerline towards the base; and a microwave energy interactive element joined to at least a portion of at least one of the opposed platforms.

2. The tray of claim 1, wherein the recess extends in the second direction substantially along the second centerline.

3. The tray of claim 1, wherein the recess is substantially coplanar with the base.

4. The tray of claim 1, wherein at least one of the opposed platforms is substantially uniform in height in the first direction.

5. The tray of claim 1, wherein at least one of the opposed platforms is substantially uniform in height in the first direction along the first centerline.

6. The tray of claim 1, wherein the tray is substantially symmetrical along at least one of the first centerline and the second centerline.

7. The tray of claim 1, further comprising a channel extending at least partially across at least one platform of the pair of opposed platforms.

8. The tray of claim 7, wherein the channel has a lowermost portion that is positioned above the base.

9. The tray of claim 7, wherein the channel is upwardly open.

10. The tray of claim 1, further comprising a plurality of channels extending at least partially across at least one platform of the pair of opposed platforms.

11. The tray of claim 1, wherein the pair of opposed platforms includes a first platform and a second platform, and the tray further comprises four channels extending at least partially across the first platform and four channels extending at least partially across the second platform.

12. The tray of claim 1, further comprising a plurality of walls extending upwardly from the base.

13. The tray of claim 1, wherein the microwave energy interactive element comprises a susceptor.

14. The tray of claim 1, wherein the pair of opposed platforms are each semi-circular in shape.

15. The tray of claim 1, wherein at least one platform of the pair of opposed platforms is semi-circular in shape.

16. The tray of claim 1, wherein the microwave energy interactive element is operative for converting microwave energy into heat.

17. A tray for heating, browning, and/or crisping a food item in a microwave oven, the tray including a first centerline extending in a first direction and a second centerline extending in a second direction, wherein the first centerline is substantially perpendicular to the second centerline, the tray comprising:

a substantially planar base;

a platform extending upwardly from the base, the platform including a heating surface having a first height relative to the base so that the heating surface is positioned above the base, wherein the heating surface comprises microwave energy interactive material, and a plurality of faces that extend outwardly and downwardly from the heating surface towards the base; and at least one upwardly open channel extending at least partially across the platform, the channel including a lowermost portion having a second height relative to the base so that the lowermost portion of the channel is positioned above the base, wherein the second height is less than the first height, such that the lowermost portion of the channel is positioned between the base and the heating surface.

18. The tray of claim 17, wherein the channel extends through at least one of the plurality of faces.

19. The tray of claim 17, wherein the channel extends in the first direction substantially perpendicular to the second centerline.

20. The tray of claim 17, wherein the channel extends in a direction oblique to the second centerline.

21. The tray of claim 17, wherein the at least one channel includes at least one channel extending in the first direction, and at least one channel extending in the second direction.

22. The tray of claim 17, wherein the microwave energy interactive material comprises a susceptor.

23. The tray of claim 17, wherein the channel curvedly extends in the second direction substantially transverse to the first direction.

24. The tray of claim 17, wherein the at least one channel includes at least one channel extending in the first direction, and at least one channel extending curvedly in the second direction.

25. The tray of claim 24, wherein the at least one channel further includes at least one channel extending in a direction oblique to the first direction.

26. The tray of claim 17, wherein the at least one channel comprises an indentation in the platform.

27. The tray of claim 17, wherein the platform is a first platform of a plurality of platforms.

28. The tray of claim 17, wherein the platform is substantially triangular in shape.

29. The tray of claim 17, wherein the tray is substantially triangular in shape.

30. The tray of claim 17, wherein the platform is substantially semi-circular in shape.

31. The tray of claim 17, wherein the tray is substantially rectangular in shape.

32. The tray of claim 17, wherein the platform is substantially circular in shape.

33. The tray of claim 17, wherein the tray is substantially circular in shape.

34. The tray of claim 17, wherein the heating surface is substantially planar, so that the first height is substantially uniform.

35. The tray of claim 17, wherein the heating surface is contoured, so that the first height varies.

36. The tray of claim 17, further comprising a peripheral wall extending upwardly from the base.

37. The tray of claim 17, wherein the microwave energy interactive material is operative for converting microwave energy into heat.

38. A tray for heating, browning, and/or crisping a food item in a microwave oven, the tray including a first centerline extending in a first direction and a second centerline extending in a second direction, wherein the first centerline is substantially perpendicular to the second centerline, the tray comprising:

a substantially planar base;

a first heating surface in an elevated position relative to the base;

a second heating surface in an elevated position relative to the base;

a microwave energy interactive material overlying at least a portion of each of the first heating surface and the second heating surface;

a first venting channel extending at least partially across the first heating surface; and a second venting channel extending at least partially across the second heating surface, the first venting channel and the second channel each being upwardly open, wherein the first heating surface and the second heating surface are each substantially uniform in height in the first direction along the first centerline, and the first heating surface and the second heating surface each decrease in height in the second direction from the first centerline outwardly towards the base.

39. The tray of claim 38, wherein at least one of the first venting channel and the second venting channel extends in the first direction substantially perpendicular to the second centerline.

40. The tray of claim 38, wherein at least one of the first venting channel and the second venting channel extends in a direction oblique to the second centerline.

41. The tray of claim 38, wherein at least one of the first venting channel and the second venting channel comprises an indentation in the respective first heating surface or second heating surface.

42. The tray of claim 38, wherein the first venting channel and the second venting channel each have a lowermost portion that is non-coplanar with the base.

43. The tray of claim 38, wherein the first heating surface and the second heating surface are semi-circular in shape.

44. The tray of claim 38, wherein the first heating surface and the second heating surface each comprise microwave energy interactive material.

45. The tray of claim 44, wherein the microwave energy interactive material is operative for heating in response microwave energy.

46. The tray of claim 38, further comprising a wall extending upwardly from the base.

47. A tray for heating, browning, and/or crisping a food item in a microwave oven comprising:

a substantially planar base defining a peripheral margin of the tray; and a substantially circular platform extending upwardly from the base, the platform including an uppermost surface for supporting a food item, wherein the uppermost surface of the platform has a height relative to the base, and wherein the height of the uppermost surface decreases substantially uniformly from a center of the platform towards the base, so that the uppermost surface of the platform has a substantially domed shape, wherein the platform includes a plurality of microwave energy interactive areas and a plurality of microwave energy transparent areas.

48. The tray of claim 47, wherein the microwave energy interactive areas are separated by the microwave energy transparent areas.

49. The tray of claim 47, wherein the microwave energy interactive areas and microwave energy transparent areas are arranged as a plurality of alternating stripes.

50. The tray of claim 47, wherein the microwave energy interactive areas are arranged as a plurality of squares, and the microwave energy transparent areas are arranged as a plurality of grid lines separating the squares.

51. The tray of claim 47, wherein the microwave energy interactive areas and microwave energy transparent areas are arranged as a plurality of concentric circles.

52. The tray of claim 47, wherein the microwave energy interactive areas comprise a microwave energy interactive material.

53. The tray of claim 47, wherein the microwave energy transparent areas comprise a deactivated microwave energy interactive material.

54. The tray of claim 47, wherein the microwave energy transparent areas comprise apertures extending through the tray.

55. The tray of claim 54, wherein the apertures are in the form of elongate slots.

56. The tray of claim 47, wherein the microwave energy interactive areas comprise microwave energy interactive material.

57. The tray of claim 56, wherein the microwave energy interactive material is operative for generating heat when sufficiently exposed to microwave energy.

58. The tray of claim 47, further comprising a wall extending upwardly from the base.

* * * * *